US008828635B2

(12) United States Patent
Moriya et al.

(10) Patent No.: US 8,828,635 B2
(45) Date of Patent: Sep. 9, 2014

(54) TONER, DEVELOPER, PROCESS CARTRIDGE, AND IMAGE FORMING APPARATUS

(75) Inventors: Yoshihiro Moriya, Shizuoka (JP); Shinya Nakayama, Shizuoka (JP); Atsushi Yamamoto, Shizuoka (JP); Hideyuki Santo, Shizuoka (JP); Akiyoshi Sabu, Shizuoka (JP); Yukiko Nakajima, Kanagawa (JP); Daiki Yamashita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 13/565,025

(22) Filed: Aug. 2, 2012

(65) Prior Publication Data

US 2013/0045442 A1 Feb. 21, 2013

(30) Foreign Application Priority Data

Aug. 16, 2011 (JP) ..... 2011-178040

(51) Int. Cl.
*G03G 9/093* (2006.01)

(52) U.S. Cl.
CPC ..... *G03G 9/09328* (2013.01); *G03G 9/09392* (2013.01); *G03G 9/09371* (2013.01)
USPC ..... 430/109.4; 430/110.2

(58) Field of Classification Search
CPC ..... G03G 9/09328; G03G 9/0371
USPC ..... 430/110.2, 109.4
See application file for complete search history.

(56) References Cited

U.S. PATENT DOCUMENTS

| | | | | |
|---|---|---|---|---|
| 2003/0138717 | A1 | 7/2003 | Yagi et al. | |
| 2008/0227002 | A1 | 9/2008 | Moriya et al. | |
| 2009/0003885 | A1 | 1/2009 | Sabu et al. | |
| 2009/0011357 | A1* | 1/2009 | Kawase et al. | 430/110.1 |
| 2010/0055595 | A1* | 3/2010 | Shirai et al. | 430/109.4 |
| 2010/0104965 | A1 | 4/2010 | Inoue et al. | |
| 2010/0330489 | A1 | 12/2010 | Inoue et al. | |
| 2011/0123920 | A1* | 5/2011 | Nair et al. | 430/108.22 |
| 2011/0229816 | A1* | 9/2011 | Shirai et al. | 430/109.4 |
| 2011/0281213 | A1* | 11/2011 | Sakashita et al. | 430/109.4 |

FOREIGN PATENT DOCUMENTS

| | | | |
|---|---|---|---|
| JP | 7-120975 | 5/1995 | |
| JP | 9-319144 | 12/1997 | |
| JP | 11007154 A * | 1/1999 | G03G 9/08 |
| JP | 2002-284881 | 10/2002 | |
| JP | 2003-140381 | 5/2003 | |
| JP | 2010-122667 | 6/2010 | |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

English language machine translation of JP 11-007154 (Jan. 1999).*

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A toner including a resin particle (C) is provided. The resin particle (C) includes a resin particle (B) and a resin particle (A). The resin particle (B) includes a resin (b). The resin particle (A) or covering layer (P) includes a resin (a). The resin particle (A) or covering layer (P) is adhered to a surface of the resin particle (B). The resin (a) is a polyester resin. The resin (a) has a total acid value of 15 to 36 mgKOH/g. The resin particle (A) or covering layer (P) has a surface acid value of 10 to 27 mgKOH/g.

17 Claims, 3 Drawing Sheets

TONER, DEVELOPER, PROCESS CARTRIDGE, AND IMAGE FORMING APPARATUS

CROSS-REFERENCE TO RELATED APPLICATIONS

This patent application is based on and claims priority pursuant to 35 U.S.C. §119 to Japanese Patent Application No. 2011-178040, filed on Aug. 16, 2011, in the Japanese Patent Office, the entire disclosure of which is hereby incorporated herein by reference.

BACKGROUND

1. Technical Field

The present disclosure relates to a toner, a developer, a process cartridge, and an image forming apparatus.

2. Description of Related Art

A method of manufacturing toner called dissolution suspension method is known. The dissolution suspension method includes the steps of dispersing a binder resin solution in an aqueous medium in the presence of a dispersant (e.g., a surfactant, a water-soluble resin) and a dispersion stabilizer (e.g., fine inorganic particles, fine resin particles) and removing the solvent by applying heat or reducing pressure. Japanese Patent Application Publication Nos. 09-319144 and 2002-284881 describe that toner particles prepared by the dissolution suspension methods have a uniform size without any classification treatment. In electrophotographic image forming apparatus, toner is required to be releasable from a heating member so as not to cause offset problem in that part of a fused toner image is adhered to the surface of the heating member and retransferred onto an undesired portion of a recording medium. Japanese Patent No. 3640918 describes that the offset problem can be solved by including a modified polyester resin in toner. Binder resin generally occupies 70% or more of toner composition. Most binder resins are derived from petroleum resources now being exposed to depletion. Petroleum resources cause a problem of global warming because they discharge carbon dioxide into the air when consumed. On the other hand, binder resins derived from plant resources have been proposed and used for toners. Because plant resources have incorporated carbon dioxide from the air in the process of growing, carbon dioxide discharged from plant resources is merely circulated between the air and plant resources. Thus, plant resources have the potential to solve the problems of both depletion and global warming. Japanese Patent No. 2909873 describes a toner including a polylactic acid as a binder resin. Generally speaking, polylactic acids have high crystallinity because the number of polar groups per unit structure is relatively large. Therefore, polylactic acids are considered not to be suitable for use in toner. Even polylactic acids having low crystallinity are considered not to be suitable for use in toner because they are poorly resistant to humidity conditions.

A toner including such a polylactic acid having low crystallinity may be difficult to stabilize its charge under low-temperature and low-humidity conditions or high-temperature and high-humidity conditions.

It is known that fine resin particles composed of styrene-acrylic backbones are used as the dispersion stabilizers in the dissolution suspension method. In this case, low-temperature fixability of the resulting toner particles is poor because the toner particles are covered with the fine resin particles composed of styrene-acrylic backbones. Such fine resin particles serving as dispersion stabilizers have a large amount of hydrophilic groups. Therefore, the fine resin particles cannot improve humidity resistance of the toner particles which may include a polylactic acid. Moreover, the surfaces of the toner particles which may include a polylactic acid are not completely covered with the fine resin particles and a part of the surfaces are exposed, which causes toner filming on carrier particles or charging members. In a case in which the surfaces of the toner particles are completely covered with the fine resin particles, low-temperature fixability further deteriorates. Therefore, it is generally difficult to make toner have low-temperature fixability, humidity resistance, and charge stability at the same time. Japanese Patent Application Publication No. 2010-122667 describes a toner including a resin having a polyhydroxycarboxylic acid skeleton obtained from optically-active monomers having an optical purity X of 80% by mole or less. The optical purity X is represented by the following formula:

$$X(\%\text{ by mole})=|X(L\text{-form})-X(D\text{-form})|$$

wherein X(L-form) and X(D-form) represent ratios (% by mole) of L-form and D-form optically-active monomers, respectively. It is described therein that the polyhydroxycarboxylic acid skeleton can be formed from a polylactic acid (PLA).

SUMMARY

In accordance with some embodiments, a toner including a resin particle (C) is provided. The resin particle (C) includes a resin particle (B) and a resin particle (A). The resin particle (B) includes a resin (b). The resin particle (A) or covering layer (P) includes a resin (a). The resin particle (A) or covering layer (P) is adhered to a surface of the resin particle (B). The resin (a) is a polyester resin. The resin (a) has a total acid value of 15 to 36 mgKOH/g. The resin particle (A) or covering layer (P) has a surface acid value of 10 to 27 mgKOH/g.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
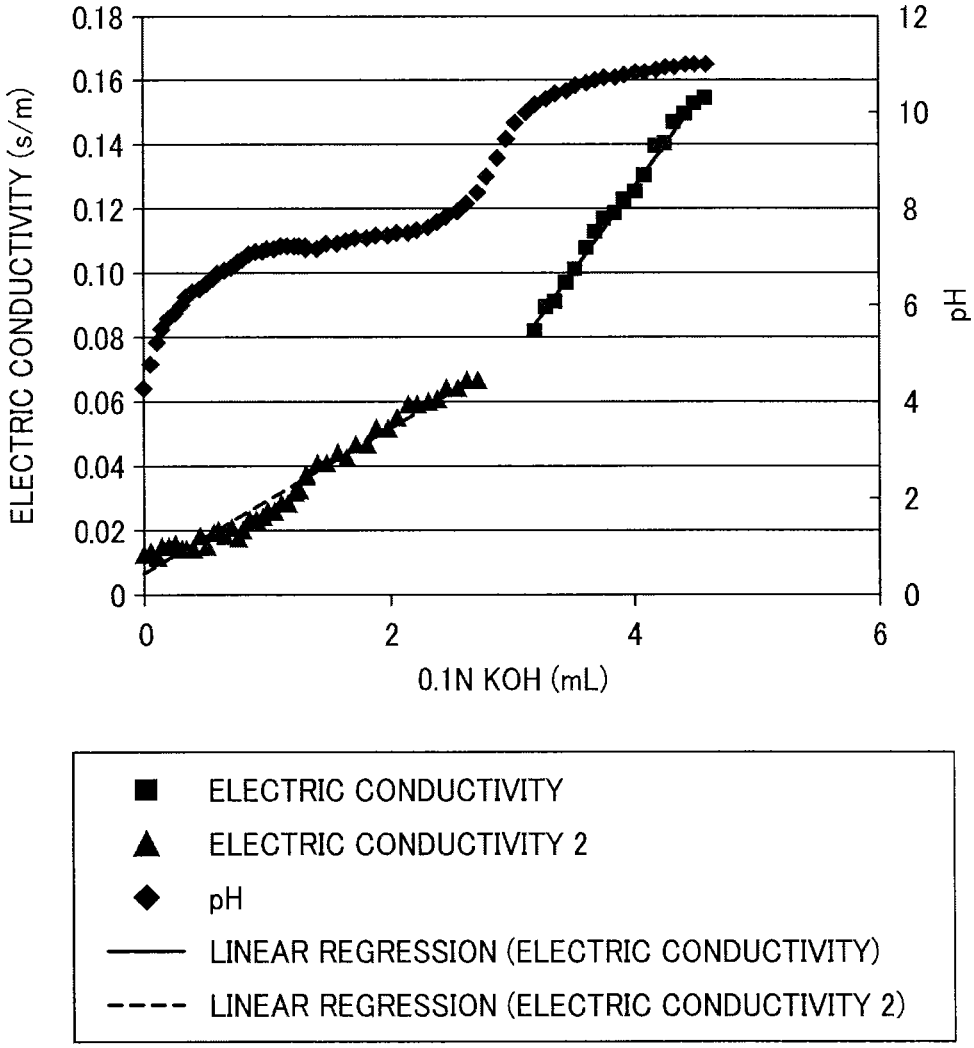
FIG. 1 is a graph showing a titration curve of resin particles with potassium hydroxide and a corresponding conductivity curve.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

The inventors of the present invention have found that, in the dissolution suspension methods, surface hydrophilicity of resin particles (i.e., dispersion stabilizers) has a significant relation to particle size distribution of resulting toner particles. Surface hydrophilicity of resin particles has a significant relation to surface acid value of the resin particles. The resin particles need to have an appropriate hydrophilicity (i.e., surface acid value) to reliably adsorb to an oil-water interface (i.e., an interface between toner components and an aqueous medium) as the dispersion stabilizers. When the hydrophilicity is too low or high, the resin particles cannot reliably adsorb to the oil-water interface and therefore particle size distribution of the resulting toner particles gets wide. This means that the resulting toner particles include a large amount of undesired fine particles and the surfaces thereof are not completely covered with the resin particles.

Such toner particles not completely covered with the resin particles undesirably cause toner filming on carrier particles or charging members.

According to an embodiment, when a toner is manufactured by the dissolution suspension method with employing a polylactic acid as a binder resin, hydrophilicity of resin particles, serving as dispersion stabilizers, is appropriately adjusted by controlling total acid value and surface acid value of the resin particles. FIG. 1 is a graph showing a titration curve of resin particles with potassium hydroxide and a corresponding conductivity curve. It is clear from FIG. 1 that the conductivity curve changes its slope after surface acids groups of the resin particles are completely replaced with hydroxyl groups of the potassium hydroxide.

As a result of the inventors' detailed study of this phenomenon, the inventor has found that the resin particles can reliably adsorb to the oil-water interface when the resin particles have a total acid value of 15 to 36 mgKOH/g and a surface acid value of 10 to 27 mgKOH/g.

According to an embodiment, a toner comprising a resin particle (C) is provided. The resin particle (C) has one of the following structures.

(1) The resin particle (C) is comprised of a resin particle (B) including a resin (b) and a resin particle (A) including a resin (a). The resin particle (A) is adhered to a surface of the resin particle (B).

(2) The resin particle (C) is comprised of a resin particle (B) including a resin (b) and a covering layer (P) including a resin (a). The covering layer (P) is adhered to a surface of the resin particle (B).

The resin (a) is a polyester resin. The resin (a) has a total acid value of 15 to 36 mgKOH/g. A surface of the resin particle (A) or covering layer (P), including the resin (a), has an acid value of 10 to 27 mgKOH/g ("surface acid value").

According to an embodiment, the resin (b) has a polyhydroxycarboxylic acid skeleton obtained from optically-active monomers. The polyhydroxycarboxylic acid skeleton has a configuration in which hydroxycarboxylic acids are polymerized or copolymerized. The polyhydroxycarboxylic acid skeleton can be obtained by hydrolysis condensation of hydroxycarboxylic acids or ring-opening polymerization of cyclic esters of hydroxycarboxylic acids, for example. In some embodiments, the polyhydroxycarboxylic acid skeleton is obtained by ring-opening polymerization of cyclic esters of hydroxycarboxylic acids. In such embodiments, molecular weight of the polyhydroxycarboxylic acid skeleton can be increased. Specific examples of usable hydroxycarboxylic acids include, but are not limited to, aliphatic hydroxycarboxylic acids (e.g., glycolic acid, lactic acid, hydroxybutyric acid), aromatic hydroxycarboxylic acids (e.g., salicylic acid, creosotic acid, mandelic acid, barrinic acid, syringic acid), and mixtures thereof. Specific examples of usable cyclic esters of these hydroxycarboxylic acids include, but are not limited to, glycolide, lactide, γ-butyrolactone, and 6-valerolactone.

In one or more embodiments, the polyhydroxycarboxylic acid skeleton is obtained from an aliphatic hydroxycarboxylic acid in view of transparency and thermal property of the resin particle (C). In some embodiments, the polyhydroxycarboxylic acid skeleton is obtained from a hydroxycarboxylic acid having 2 to 6 carbon atoms. In some embodiments, the polyhydroxycarboxylic acid skeleton is obtained from glycolic acid, lactic acid, glycolide, or lactide. In some embodiments, the polyhydroxycarboxylic acid skeleton is obtained from glycolic acid or lactic acid.

When cyclic esters of hydroxycarboxylic acids are used, the resulting polyhydroxycarboxylic acid skeleton has a configuration in which the hydroxycarboxylic acids are polymerized.

For example, the polyhydroxycarboxylic acid skeleton obtained from lactic acid lactide has a configuration in which lactic acid is polymerized. In some embodiments, the polyhydroxycarboxylic acid skeleton is obtained from optically-active monomers, such as lactic acid, having an optical purity X of 80% by mole or less or 60% by mol or less. The optical purity X is represented by the following formula:

$$X(\%\text{ by mole})=|X(L\text{-form})-X(D\text{-form})|$$

wherein X(L-form) and X(D-form) represent ratios (% by mole) of L-form and D-form optically-active monomers, respectively. When the optical purity is 80% by mol or less, solvent solubility and transparency of the resulting resin improve. Such a resin is useful in a toner manufacturing method (I) to be described later.

The resin (b) contributes to uniform dispersion of colorants and waxes in the toner. The resin (b) also contributes to improvement in image density and haze degree, even when the toner contains a colorant and a wax, because of having high transparency.

In some embodiments, the resin (b) includes a straight-chain polyester resin (b1) obtained by reacting a polyester diol (b11) having a polyhydroxycarboxylic acid skeleton with a polyester diol (b12) other than the polyester diol (b11) with an elongating agent. The straight-chain polyester resin (b1) is easy to control its molecular weight and properties (e.g., thermal properties, compatibility with other resins) owing to its simple structure.

Properties of the straight-chain polyester resin (b1) can be controlled by varying chemical species, molecular weight, and/or molecular structure of the polyester diol (b12) as well as the polyester diol (b11). Each of the polyester diol (b11), polyester diol (b12), and elongating agent is difunctional. When one of them is trifunctional or more functional, the resulting polyester resin does not have a straight-chain structure because cross-linking reaction excessively proceeds.

The polyester diol (b11) having a polyhydroxycarboxylic acid skeleton can be obtained by copolymerizing a hydroxycarboxylic acid with a diol (11). Specific examples of the diol (11) include, but are not limited to, 1,2-propylene glycol, 1,3-propylene glycol, 1,4-butanediol, 1,6-hexanediol, alkylene oxide (hereinafter "AO", such as ethylene oxide ("EO"), propylene oxide ("PO"), and butylene oxide ("BO")) 2-30 mol adducts of bisphenols (e.g., bisphenol A, bisphenol F, bisphenol S), and combinations thereof. In some embodiments, 1,2-propylene glycol, 1,3-propylene glycol, 1,4-butanediol, or an AO adduct of bisphenol A is used. In some embodiments, 1,3-propylene glycol is used.

The polyester diol (b12), other than the polyester diol (b11), can be obtained by reacting the diol (11) with a dicarboxylic acid (13) while controlling the ratio between the diol (11) and the dicarboxylic acid (13) so that hydroxyl groups are excessive. Specific examples of the polyester diol (b12) include, but are not limited to, reaction products of at least one member selected from 1,2-propylene glycol, 1,3-propylene glycol, 1,4-butanediol, 1,6-hexanediol, AO (e.g., EO, PO, BO) 2-30 mol adducts of bisphenols (e.g., bisphenol A, bisphenol F, bisphenol S), and combinations thereof, with at least one member selected from terephthalic acid, isophthalic acid, adipic acid, succinic acid, and combinations thereof.

According to an embodiment, each of the polyester diol (b11) and polyester diol (b12) has a number average molecular weight (Mn) of 500 to 30,000, or 1,000 to 20,000, or 2,000 to 5,000, in view of controllability of properties of the straight-chain polyester resin (b1).

The elongating agent for elongating the polyester diol (b11) with the polyester diol (b12) is a compound having two functional groups each reactive with hydroxyl group in the polyester diol (b11) and polyester diol (b12). Such a compound may be a difunctional dicarboxylic acid (13) or an anhydride thereof, a difunctional polyisocyanate (15), or a difunctional polyepoxide (19). In some embodiments, a diisocyanate compound or a dicarboxylic acid compound is used as the elongating agent in view of compatibility of the polyester diol (b11) with the polyester diol (b12). Specific examples of such difunctional compounds further include, but are not limited to, succinic acid, adipic acid, maleic acid (and anhydride thereof), fumaric acid (and anhydride thereof), phthalic acid, isophthalic acid, terephthalic acid, 1,3- and/or 1,4-phenylene diisocyanate, 2,4- and/or 2,6-tolylene diisocyanate ("TDI"), 2,4'- and/or 4,4'-diphenylmethane diisocyanate ("MDI"), hexamethylene diisocyanate ("HDI"), dicyclohexylmethane-4,4'-diisocyanate ("hydrogenated MDI"), isophorone diisocyanate ("IPDI"), and bisphenol A diglycidyl ether. In some embodiments, succinic acid, adipic acid, isophthalic acid, terephthalic acid, maleic acid (and anhydride thereof), fumaric acid (and anhydride thereof), HDI, or IPDI is used. In some embodiments, maleic acid (and anhydride thereof), fumaric acid (and anhydride thereof), or IPDI is used.

According to an embodiment, the content of the elongating agent in the straight-chain polyester resin (b1) is 0.1 to 30% by weight, or 1 to 20% by weight.

According to an embodiment, the content of the straight-chain polyester resin (b1) in the resin (b) is 40 to 100% by weight, or 60 to 90% by weight, in view of transparency and thermal properties of the resin particle (C). In a case in which the straight-chain polyester resin (b1) is obtained from an optically-active hydroxycarboxylic acid, such as lactic acid, and its optical purity X is 80% by mole or less, the content of the straight-chain polyester resin (b1) in the resin (b) may be 40 to 100% by weight, or 60 to 90% by weight, in view of solvent solubility. By contrast, in a case in which its optical purity is greater than 80% by mole, the content Y (% by weight) of the straight-chain polyester resin (b1) in the resin (b) and the optical purity X (% by mole) may satisfy the formula $Y \leq -1.5X+220$, in view of solvent solubility.

According to an embodiment, when reacting the polyester diol (b11) with the polyester diol (b12) to obtain the polyhydroxycarboxylic acid skeleton, the weight ratio of the polyester diol (b11) to the polyester diol (b12) is 31/69 to 90/10, or 40/60 to 80/20, in view of transparency and thermal properties of the resin particle (C).

The resin (b) may further include a resin other than the straight-chain polyester resin (b1). Usable resins include, for example, a resin (b2) obtained by reacting a precursor (b0) during the formation process of the resin particle (C). Specific examples of the precursor (b0) and methods for obtaining the resin (b2) are described in detail later.

Usable resins further include, for example, vinyl resins, polyester resins, polyurethane resins, epoxy resins, and combinations thereof. In some embodiments, a polyurethane resin or a polyester resin is used. In some embodiments, a polyurethane or polyester resin having a unit of 1,2-propylene glycol is used.

According to an embodiment, the content of the resin other than the straight-chain polyester resin (b1) in the resin (b) is 0 to 60% by weight, or 10 to 40% by weight, in view of transparency and thermal properties of the resin particle (C).

The resin (b) is variable in terms of number average molecular weight (Mn) (measured by GPC), melting point (measured by DSC), glass transition temperature (Tg), and solubility parameter (SP) (measured by a method disclosed in a document entitled "Polymer Engineering and Science", February, 1974, Vol. 14, No. 2, p. 147-154).

In some embodiments, the resin (b) has a number average molecular weight (Mn) of 1,000 to 5,000,000, or 2,000 to 500,000. In some embodiments, the resin (b) has a melting point of 20 to 300° C., or 80 to 250° C. In some embodiments, the resin (b) has a glass transition temperature (Tg) of 20 to 200° C., or 40 to 200° C. In some embodiments, the resin (b) has a solubility parameter (SP) of 8 to 16, or 9 to 14.

The glass transition temperature (Tg) can be measured with a differential scanning calorimeter (DSC) or a flowtester.

For example, Tg can be measured with an instrument DSC-20 SSC/580 from Seiko Instruments Inc. based on a method according to ASTM D3418-82.

Also, Tg can be measured with a flowtester CFT-500 from Shimadzu Corporation under the following conditions.

Load: 30 kg/cm$^2$

Heating rate: 3.0° C./min

Die diameter: 0.50 mm

Die length: 10.0 mm

According to an embodiment, the resin (a) is a polyester resin having a total acid value of 15 to 36 mgKOH/g, and the resin particle (A) or covering layer (P) including the resin (a) has a surface acid value of 10 to 27 mgKOH/g. When the total acid value is greater than 36 mgKOH/g or the surface acid value is greater than 27 mgKOH/g, the resin particle (A) or covering layer (P) may not be uniformly and reliably fixed to the surface of the resin particle (B) and its water resistance may be poor. When the total acid value is less than 15 mgKOH/g or the surface acid value is less than 10 mgKOH/g, the content of carboxyl groups, which contribute to hydrophilicity, is too small to prepare a reliable aqueous dispersion of the resin (a). The resulting toner particles may include a large amount of undesired ultrafine particles and its particle size distribution may be wide. In some embodiments, the resin (a) has a weight average molecular weight of 9,000 or more, which is measured by gel permeation chromatography ("GPC") and is converted from polystyrene standard samples. Alternatively, in some embodiments, the resin (a) has a relative viscosity of 1.20 or more, which is measured at 20° C. by dissolving 1% by weight of the resin (a) in a mixed solvent in which an amount of phenol is mixed with the same amount of 1,1,2,2,-tetrachloroethane.

When the weight average molecular weight is less than 9,000 or the relative viscosity is less than 1.20, processability of the covering layer formed from an aqueous dispersion of the resin (a) may be poor. In some embodiments, the resin (a) has a weight average molecular weight of 12,000 to 45,000, or 15,000 to 45,000. Such a resin (a) having a weight average molecular weight greater than 45,000 may be manufactured with poor operability. When the weight average molecular weight is greater than 45,000, an aqueous dispersion of the resin (a) may have abnormally high viscosity. In some embodiments, the resin (a) has a relative viscosity of 1.22 to 1.95, or 1.24 to 1.95. Such a resin (a) having a relative viscosity greater than 1.95 may be manufactured with poor operability. When the relative viscosity is greater than 1.95, an aqueous dispersion of the resin (a) may have abnormally high viscosity.

According to an embodiment, the resin (a) is inherently neither dispersible nor soluble in water and is obtained by reacting a polybasic acid with a polyol.

Specific examples of usable polybasic acids include, but are not limited to, aromatic dicarboxylic acids such as terephthalic acid, isophthalic acid, orthophthalic acid, naphthalenedicarboxylic acid, and biphenyl dicarboxylic acid. These polybasic acids can be used in combination with a small amount of 5-sulfoisophthalate sodium or 5-hydroxyisophthalic acid so long as water resistance does not deteriorate. Specific examples of usable polybasic acids further include, but are not limited to, aliphatic dicarboxylic acids such as saturated dicarboxylic acids (e.g., oxalic acid, succinic acid and anhydride thereof, adipic acid, azelaic acid, sebacic acid, dodecanedioic acid, hydrogenated dimer acid) and unsaturated dicarboxylic acids (e.g., fumaric acid, maleic acid and anhydride thereof, itaconic acid and anhydride thereof, citraconic acid and anhydride thereof, dimer acid). Specific examples of usable polybasic acids further include, but are not limited to, alicyclic dicarboxylic acids such as 1,4-cyclohexanedicarboxylic acid, 1,3-cyclohexanedicarboxylic acid, 1,2-cyclohexanedicarboxylic acid, 2,5-norbornenedicarboxylic acid and anhydride thereof, and tetrahydrophthalic acid and anhydride thereof.

Specific examples of usable polyols include, but are not limited to, aliphatic glycols having 2 to 10 carbon atoms, alicyclic glycols having 6 to 12 carbon atoms, and glycols having ether bond. Specific examples of the aliphatic glycols having 2 to 10 carbon atoms include, but are not limited to, ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol, and 2-ethyl-2-butylpropanediol. Specific examples of the alicyclic glycols having 6 to 12 carbon atoms include, but are not limited to, 1,4-cyclohexanedimethanol. Specific examples of the glycols having ether bond include, but are not limited to, diethylene glycol, triethylene glycol, dipropylene glycol, and a glycol obtained by adding one to several moles of ethylene oxide or propylene oxide to two phenolic hydroxyl groups of a bisphenol (e.g., 2,2-bis(4-hydroxyethoxyphenyl)propane). Specific examples of usable polyols further include, but are not limited to, polyethylene glycol, polypropylene glycol, and polytetramethylene glycol. In some embodiments, the content of the ether bond in the polyol is 10% by weight or less, or 5% by weight or less, because the ether structure degrades water resistance and weather resistance of the resin (a).

In some embodiments, the resin (a) is obtained from a polyol including ethylene glycol and/or neopentyl glycol in an amount of 50% by mole or more, or 65% by mole or more. In such embodiments, the resin (a) has a balanced performance. In particular, ethylene glycol improves chemical resistance and neopentyl glycol improves weather resistance. Ethylene glycol and neopentyl glycol are industrially produced in large volume and are available at low cost.

In some embodiments, the resin (a) is obtained by copolymerizing trifunctional or more functional polybasic acid and/or polyol with the above-described polybasic acid and/or polyol. Specific examples of usable trifunctional or more functional polybasic acids include, but are not limited to, trimellitic acid and anhydride thereof, pyromellitic acid and anhydride thereof, benzophenonetetracarboxylic acid and anhydride thereof, trimesic acid, ethylene glycol bis(anhydrotrimellitate), glycerol tris(anhydrotrimellitate), and 1,2,3,4-butanetetracarboxylic acid. Specific examples of usable trifunctional or more functional polyols include, but are not limited to, glycerin, trimethylolethane, trimethylolpropane, and pentaerythritol.

In the copolymerization, the ratio of the trifunctional or more functional polybasic acid and/or polyol is 10% by mole or less, or 5% by mole or less, based on the total polybasic acid and/or polyol. When the ratio is greater than 10% by mole, the resin (a) may not express high processability.

The following compounds are also usable for preparing the resin (a): fatty acids (e.g., lauric acid, myristic acid, palmitic acid, stearic acid, oleic acid, linoleic acid, linolenic acid) and ester-formable derivatives thereof; high-boiling-point monocarboxylic acids (e.g., benzoic acid, p-tert-butyl benzoic acid, cyclohexane acid, 4-hydroxyphenyl stearic acid); high-boiling-point monoalcohols (e.g., stearyl alcohol, 2-phenoxyethanol); and hydroxycarboxylic acids (e.g., ε-caprolactone, lactic acid, β-hydroxybutyric acid, p-hydroxybenzoic acid) and ester-formable derivatives thereof.

The resin (a), which is a polyester resin, can be prepared by the following methods, for example. (1) Subject all monomers and/or lower polymers to an esterification reaction in an inert atmosphere at 180 to 250° C. for 2.5 to 10 hours and then a polycondensation reaction in the presence of a catalyst under a reduced pressure of 1 Torr or less at 220 to 280° C. until the melt viscosity attains a desired value, thus obtaining a polyester resin. (2) Terminate the polycondensation reaction before the melt viscosity attains a desired value. React the reaction product with a chain extender selected from a polyfunctional epoxy compound, an isocyanate compound, or an oxazoline compound for a short time, thus obtaining a high-molecular-weight polyester resin. (3) Proceed the polycondensation reaction until the melt viscosity exceeds a desired value. Further mix the reaction product with extra monomers and subject the mixture to a depolymerization in an inert atmosphere under normal or additional pressures, thus obtaining a polyester resin having a desired melt viscosity.

Carboxyl groups more frequently exist on the ends of the resin chain rather than the backbone of the resin chain in view of water resistance of the covering layer to be formed. A certain amount of carboxyl groups can be introduced into the ends of the polyester resin chain by: in the above method (1), adding a trifunctional or more functional polybasic acid after the polycondensation reaction is initiated, or adding an acid anhydride of a polybasic acid immediately before the polycondensation is terminated; in the above method (2), by extending low-molecular-weight polyester resin chains having terminal carboxyl groups with a chain extender; and in the above method (3), by using a polybasic acid as the depolymerization agent.

The polyester resin can be formed into an aqueous dispersion having a concentration of 0.5 to 50% by weight, or 1 to 40% by weight. Even when the concentration of the polyester resin is relatively high, i.e., exceeds 20% by weight, the aqueous dispersion keeps storage stability. When the concentration of the polyester resin exceeds 50% by weight, it may be difficult to form a reliable aqueous dispersion due to high viscosity.

According to an embodiment, the resin (a) is neutralized with a basic compound when being dispersed in an aqueous medium. Neutralization of carboxyl groups in the resin (a) provides impetus for forming an aqueous dispersion of the resin (a) particles. Moreover, the resulting resin (a) particles are prevented from aggregating due to electric repulsive force generated between carboxyl anions produced in the neutralization. The basic compound may be a compound which volatilizes upon formation the covering layer or upon mixing of a hardening agent to cause bake-hardening. Such compounds include, for example, ammonia and organic amine compounds having a boiling point of 250° C. or less. Specific examples of usable organic amine compounds include, but are not limited to, triethylamine, N,N-diethylethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine, triethanolamine, morpholine, N-methylmorpholine, and N-ethylmorpholine. According to an embodiment, the added amount of the basic compound is 0.2 to 1.5 times, or 0.4 to 1.3 times, equivalent of the carboxyl groups in the resin (a), so that at least a part of the carboxyl groups are neutralized. When the added amount is less than 0.2 times the equivalent, the basic compound cannot produce its effect. When the added amount is greater than 1.5 times the equivalent, the aqueous medium of the resin (a) may excessively increase its viscosity.

To accelerate formation of an aqueous dispersion of the resin (a) particles, an amphiphilic organic solvent may be used.

Specific examples of usable amphiphilic organic solvents include, but are not limited to, alcohols (e.g., ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-propanol, n-hexanol, cyclohexanol), ketones (e.g., methyl ethyl ketone, methyl isobutyl ketone, ethyl butyl ketone, cyclohexanone, isophorone), ethers (e.g., tetrahydrofuran, dioxane), esters (e.g., ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate, dimethyl carbonate), glycol derivatives (e.g., ethylene glycol, ethylene glycol monomethyl ether, ethylene glycol monoethyl ether, ethylene glycol monobutyl ether, ethylene glycol ethyl ether acetate, diethylene glycol, diethylene glycol monomethyl ether, diethylene glycol monoethyl ether, diethylene glycol monobutyl ether, diethylene glycol ethyl ether acetate, propylene glycol, propylene glycol monomethyl ether, propylene glycol monobutyl ether, propylene glycol methyl ether acetate), 3-methoxy-3-methylbutanol, 3-methoxybutanol, acetonitrile, dimethylformamide, dimethylacetamide, diacetone alcohol, and ethyl acetoacetate. Two or more of these solvents can be used in combination.

According to an embodiment, the resin particle (C) includes the resin particle (B) including the resin (b) and the resin particle (A) or covering layer (P) including the resin (a). The resin particle (A) or covering layer (P) is covering a surface of the resin particle (B).

The resin particle (C) can be prepared by the following method (I) or (II), for example.

(I) Mix an aqueous dispersion (W) of the resin particle (A) including the resin (a) with an organic solvent solution or dispersion (O1) of the resin (b) or an organic solvent solution or dispersion (O2) of the precursor (b0) of the resin (b) so that the organic solvent solution or dispersion (O1) or (O2) is dispersed in the aqueous dispersion (W) and the resin particle (B) including the resin (b) is formed in the aqueous dispersion (W).

In this method, the resin particle (A) or covering layer (P) is adhered to a surface of the resin particle (B) upon formation of the resin particle (B), thus preparing the aqueous dispersion (X) of the resin particle (C). The resin particle (C) is isolated by removing the aqueous media from the aqueous dispersion (X).

(II) Prepare the resin particle (B) including the resin (b) in advance and coat the resin particle (B) with a coating agent (W') including the resin (a).

The coating agent (W') may be either liquid or solid. Alternatively, the resin particle (B) may be coated with a precursor (a') of the resin (a) first, followed by formation of the resin (a) by a reaction. The resin particle (B) may be prepared by, for example, an emulsion polymerization aggregation process or a pulverization process. The coating method is not limited to a particular method. One coating method includes dispersing the resin particle (B) or a dispersion thereof in the aqueous dispersion (W) of the resin particle (A) including the resin (a). Another coating method includes pouring a solution of the resin (a) on the resin particle (B).

In some embodiments, upon formation of the resin particle (B) by dispersing the organic solvent solution or dispersion (O1) of the resin (b) or the organic solvent solution or dispersion (O2) of the precursor (b0) of the resin (b) in the aqueous dispersion (W) of the resin particle (A), the resin particle (A) adsorb to a surface of the resin particle (B) so as to prevent coalescence or fission of the resin particle (C) under high shearing force. In such embodiments, the particle diameter distribution of the resin particle (C) is more narrowed. In such embodiments, the resin particle (A) has enough strength not to be destroyed by shearing force at a temperature at which the organic solvent solution or dispersion (O1) or (O2) is dispersed in the aqueous dispersion (W). The resin particle (A) is poorly soluble or swellable in water. Also, the resin particle (A) is poorly soluble in the resin (b) or the organic solvent solution or dispersion (O1) thereof, or the resin (b) and precursor (b0) or the organic solvent solution or dispersion (O2) thereof.

Other toner constituents, such as a colorant, a release agent, and a modified layered inorganic mineral, are contained in the resin particle (B). To make toner constituents contained in the resin particle (B), the toner constituents are previously dispersed in the organic solvent solution or dispersion (O1) or (O2) before the organic solvent solution or dispersion (O1) or (O2) is mixed with the aqueous dispersion (W). A charge controlling agent may be either contained in the resin particle (B) or externally added. In the former case, the charge controlling agent is previously dispersed in the organic solvent solution or dispersion (O1) or (O2) before the organic solvent solution or dispersion (O1) or (O2) is mixed with the aqueous dispersion (W). In the latter case, the charge controlling agent is externally added the resin particle (C).

The resin (a) may be adjusted in terms of molecular weight, solubility parameter (SP) (measured by a method disclosed in a document entitled "Polymer Engineering and Science", February, 1974, Vol. 14, No. 2, p. 147-154), crystallinity, molecular weight between cross-linking points, etc., so that the resin particle (A) gets less soluble or swellable in water and solvents.

Number average molecular weight (Mn) and weight average molecular weight (Mw) of THF-soluble components in resins other than polyurethane resins can be measured by gel permeation chromatography (GPC) under the following conditions, for example.

Instrument: HLC-8120 from TOSOH CORPORATION
Columns: TSKgel GMHXL×2, TSKgel Multipore HXL-M×1
Sample solution: 0.25% THF solution
Injection volume: 100 μL
Flow rate: 1 mL/min
Measuring temperature: 40° C.
Detector: Refractive index detector
Reference substance: TSK standard POLYSTYRENE from TOSOH CORPORATION (having a molecular weight of 500, 1,050, 2,800, 5,970, 9,100, 18,100, 37,900, 96,400, 190,000, 355,000, 1,090,000, and 2,890,000)

Number average molecular weight (Mn) and weight average molecular weight (Mw) of polyurethane resins can be measured by gel permeation chromatography (GPC) under the following conditions, for example.

Instrument: HLC-8220GPC from TOSOH CORPORATION
Columns: Guardcolumn α, TSKgel α-M
Sample solution: 0.125% dimethylformamide solution
Injection volume: 100 μL
Flow rate: 1 mL/min
Measuring temperature: 40° C.
Detector: Refractive index detector
Reference substance: TSK standard POLYSTYRENE from TOSOH CORPORATION (having a molecular weight of 500, 1,050, 2,800, 5,970, 9,100, 18,100, 37,900, 96,400, 190,000, 355,000, 1,090,000, and 2,890,000)

In some embodiments, the resin (a) has a glass transition temperature (Tg) of 50 to 100° C., 51 to 90° C., or 52 to 75° C., in view of particle size distribution, fluidity, heat resistance storage stability, and stress resistance of the resin particle (C). When Tg of the resin (a) is lower than the temperature at which the aqueous dispersion thereof is prepared, coalescence or fission of the resulting particle (C) cannot be sufficiently prevented and therefore particle size distribution of the resin particle (C) may be widen. For the same reason, in some embodiments, the resin particle (A) or covering layer (P) including the resin (a) has a glass transition temperature (Tg) of 20 to 200° C., 30 to 100° C., or 40 to 85° C.

The glass transition temperature (Tg) can be measured with a differential scanning calorimeter (DSC) or a flowtester.

For example, Tg can be measured with an instrument DSC-20 SSC/580 from Seiko Instruments Inc. based on a method according to ASTM D3418-82. Also, Tg can be measured with a flowtester CFT-500 from Shimadzu Corporation under the following conditions.

Load: 30 kg/cm$^2$
Heating rate: 3.0° C./min
Die diameter: 0.50 mm
Die length: 10.0 mm The glass transition temperature (Tg) of the resin (a) can be controlled by varying the molecular weight and/or monomer composition of the resin (a). The molecular weight of the resin (a) can be controlled by varying the ratio of monomers to be polymerized. Generally, the greater the molecular weight, the greater the glass transition temperature.

The aqueous dispersion (W) of the resin particle (A) may further include a water-miscible organic solvent (e.g., acetone, methyl ethyl ketone). Usable water-miscible organic solvents include those which do not cause aggregation of the resin particle (A), do not dissolve the resin particle (A), and do not prevent formation of the resin particle (C). The content of the water-miscible organic solvent may be 40% by weight or less. The water-miscible organic solvent may not remain in the resin particle (C) having been dried.

In some embodiments, the organic solvent solution or dispersion (O1) of the resin (b) or the organic solvent solution or dispersion (O2) of the precursor (b0) of the resin (b) includes an organic solvent (u). In some embodiments, the organic solvent (u) is added to the aqueous dispersion (W) of the resin particle (A) at the time the organic solvent solution or dispersion (O1) or (O2) is dispersed in the aqueous dispersion (W). Specific examples of the organic solvent (u) include, but are not limited to, aromatic hydrocarbon solvents (e.g., ethylbenzene, tetralin), aliphatic or alicyclic hydrocarbon solvents (e.g., n-hexane, n-heptane, mineral spirit cyclohexane), halogen solvents (e.g., methyl chloride, methyl bromide, methyl iodide, methylene dichloride, carbon tetrachloride, trichloroethylene, perchloroethylene), ester or ester ether solvents (e.g., ethyl acetate, butyl acetate, methoxybutyl acetate, methyl cellosolve acetate, ethyl cellosolve acetate), ether solvents (e.g., diethyl ether, tetrahydrofuran dioxane, ethyl cellosolve, butyl cellosolve, propylene glycol monomethyl ether), ketone solvents (e.g., acetone, methyl ethyl ketone, methyl isobutyl ketone, di-n-butyl ketone, cyclohexanone), alcohol solvents (e.g., methanol, ethanol, n-propanol, isopropanol, n-butanol, isobutanol, t-butanol, 2-ethylhexyl alcohol, benzyl alcohol), amide solvents (e.g., dimethylformamide, dimethylacetamide), sulfoxide solvents (e.g., dimethylsulfoxide), and heterocyclic solvents (e.g., N-methylpyrrolidone). Two or more of these solvents can be used in combination.

In some embodiments, the organic solvent solution or dispersion (O1) of the resin (b) or the organic solvent solution or dispersion (O2) of the precursor (b0) of the resin (b) includes a plasticizer (v). In some embodiments, the plasticizer (v) is added to the aqueous dispersion (w) of the resin particle (a) at the time the organic solvent solution or dispersion (O1) or (O2) is dispersed in the aqueous dispersion (w). Specific examples of the plasticizer (v) include, but are not limited to, (v1) phthalates (e.g., dibutyl phthalate, dioctyl phthalate, butyl benzyl phthalate, diisodecyl phthalate), (v2) dibasic acid esters (e.g., di-2-ethylhexyl adipate, 2-ethylhexyl sebacate), (v3) trimellitates (e.g., tri-2-ethylhexyl trimellitate, trioctyl trimellitate), (v4) phosphates (e.g., triethyl phosphate, tri-2-ethylhexyl phosphate, tricresyl phosphate), (v5) fatty acid esters (e.g., butyl oleate), and (v6) mixtures of two or more of the above compounds.

According to an embodiment, the particle diameter of the resin particle (A) is smaller than that of the resin particle (B). In one or more embodiments, the ratio of the volume average particle diameter of the resin particle (A) to that of the resin particle (B) is from 0.001 to 0.3. In some embodiments, the lower and upper limits of the ratio is 0.003 and 0.25, respectively. When the volume average particle diameter ratio exceeds 0.3, the resin particle (A) may adsorb to the resin particle (B) with a low efficiency. As a result, the particle size distribution of the resin particle (C) gets wider.

The volume average particle diameter of the resin particle (A) is adjusted so that the resin particle (C) has a desired particle diameter. In one or more embodiments, the volume average particle diameter of the resin particle (A) is from 0.0005 to 1 μm. In some embodiments, the upper limit of the volume average particle diameter of the resin particle (A) is 0.75 μm or 0.5 μm and the lower limit thereof is 0.01 μm, 0.02 μm, or 0.04 μm.

For example, to obtain the resin particle (C) having a volume average particle diameter of 1 μm, the volume average particle diameter of the resin particle (A) is adjusted to 0.0005 to 0.30 μm, or 0.001 to 0.2 μm. To obtain the resin particle (C) having a volume average particle diameter of 10 μm, the volume average particle diameter of the resin particle (A) is adjusted to 0.005 to 0.8 μm, or 0.05 to 1 μm.

As described above, the particle diameter of the resin particle (A) is smaller than that of the resin particle (B). In one or more embodiments, the ratio of the volume average particle diameter of the resin particle (A) to that of the resin particle (B) is from 0.001 to 0.3, or 0.003 to 0.25. The volume average particle diameter of the resin particle (A) is adjusted so that the resin particle (C) has a desired particle diameter. In some embodiments, the volume average particle diameter of the resin particle (A) is 0.03 to 0.15 μm, 0.03 to 0.12 μm, or 0.03 to 0.10 μm.

The volume average particle diameter of the resin particle (A) has a large effect on dispersing stability of the resin particle (A) serving as a dispersing stabilizer for stabilizing dispersion of the resin particle (B) by covering the surface of the resin particle (B). When the volume average particle diameter of the resin particle (A) falls below 0.03 μm, it is likely that the resin particle (A) is dissolved by the organic solvent when being adhered to the surface of the resin particle (B) and aggregates or coalesces on the surface of the resin particle (B). It may be difficult to make the resin particle (A) uniformly cover the resin particle (B). When the volume average particle diameter of the resin particle (A) exceeds 0.15 μm, the resin particle (A) may be too large to uniformly cover the resin particle (B).

Namely, when the volume average particle diameter of the resin particle (A) is too small or large, the surface of the resin particle (C) becomes nonuniform and dispersion stability thereof deteriorates. In such cases, the dispersion time (granulation time) needs to be controlled. Also, the resulting toner may have poor filming resistance. The volume average particle diameter can be measured with an instrument such as Particle Size Distribution Analyzer LA-920 (from HORIBA, Ltd.), Multisizer III (from Beckman Coulter, Inc.), or ELS-800 (from Otsuka Electronics Co., Ltd.) employing a laser Doppler optical system. In some embodiments, the volume average particle diameter of the resin particle (B) is 0.1 to 15 μm, 0.5 to 10 μm, or 1 to 8 μm.

The precursor (b0) of the resin (b2) may be, for example, a combination of a prepolymer (α) having a reactive group with a hardener (β). Here, the reactive group is defined as a group reactive with the hardener (β). The resin particle (B) including the resin (b2), obtained from the precursor (b0), can be prepared by: dispersing an oily liquid including the prepolymer (α) having a reactive group, the hardener (β), and an optional organic solvent (u) in an aqueous dispersion of the resin particle (A) and applying heat thereto to initiate a reaction between the prepolymer (α) and the hardener (β); dispersing the prepolymer (α) having a reactive group or an organic solvent solution or dispersion thereof in an aqueous dispersion of the resin particle (A) and further adding the hardener (β) which is water-soluble thereto to initiate a reaction between the prepolymer (α) and the hardener (β); or dispersing the prepolymer (α) having a reactive group which is hardenable by water or an organic solvent solution or dispersion thereof in an aqueous dispersion of the resin particle (A) to initiate a reaction between the prepolymer (α) and water.

Specific combinations of the prepolymer (α) and the hardener (β) include the following combinations (1) and (2), for example.

(1) The prepolymer (α) is that having a functional group (α1) reactive with a compound having an active hydrogen group and the hardener (β) is a compound (β1) having an active hydrogen group.

(2) The prepolymer (α) is that having an active hydrogen group (α2) and the hardener (β) is a compound (β2) reactive with an active hydrogen group.

In the above combination (1), the functional group (α1) reactive with a compound having an active hydrogen group may be, for example, an isocyanate group (α1a), a blocked isocyanate group (α1b), an epoxy group (α1c), an acid anhydride group (α1d), or an acid halide group (α1e). In some embodiments, an isocyanate group (α1a), a blocked isocyanate group (α1b), or an epoxy group (α1c) is employed. In some embodiments, an isocyanate group (α1a) or a blocked isocyanate group (α1b) is employed. The blocked isocyanate group (α1b) is defined as an isocyanate group blocked with a blocking agent. Specific materials usable as the blocking agent include, but are not limited to, oximes (e.g., acetoxime, methyl isobutyl ketoxime, diethyl ketoxime, cyclopentanone oxime, cyclohexanone oxime, methyl ethyl ketoxime), lactams (e.g., γ-butyrolactam, ε-caprolactam, γ-valerolactam), aliphatic alcohols having 1 to 20 carbon atoms (e.g., methanol, ethanol, octanol), phenols (e.g., phenol, cresol, xylenol, nonylphenol), active methylene compounds (e.g., acetylacetone, ethyl malonate, ethyl acetoacetate), basic nitrogen-containing compounds (e.g., N,N-diethylhydroxylamine, 2-hydroxypyridine, pyridine-N-oxide, 2-mercaptopyridine), and mixtures thereof.

In some embodiments, an oxime is used. In some embodiments, methyl ethyl oxime is used.

The prepolymer (α) having a reactive group may comprise a polyether (αw) skeleton, a polyester (αx) skeleton, an epoxy resin (αy) skeleton, or a polyurethane (αz) skeleton. In some embodiments, a polyester (αx) skeleton, an epoxy (αy) skeleton, or a polyurethane (αz) skeleton is employed. In some embodiments, a polyester (αx) skeleton or a polyurethane (αz) skeleton is employed. The polyether (αw) may be, for example, polyethylene oxide, polypropylene oxide, polybutylene oxide, or polytetramethylene oxide. The polyester (αx) may be, for example, a polycondensation product of a diol (11) with a dicarboxylic acid (13) or a polylactone (i.e., a ring-opening polymerization product of ε-caprolactone). The epoxy resin (αy) may be, for example, an addition condensation product of a bisphenol (e.g., bisphenol A, bisphenol F, bisphenol S) with epichlorohydrin. The polyurethane (αz) may be, for example, a polyaddition product of a diol (11) with a polyisocyanate (15) or a polyaddition product of the polyester (αx) with a polyisocyanate (15).

A reactive group can be introduced to the polyester (αx), epoxy resin (αy), or polyurethane (αz) by the following methods [1] and [2].

[1] React two or more components with one particular component being excessive so that a functional group of the particular component remains on a terminal.

[2] React two or more components with one particular component being excessive so that a functional group of the particular component remains on a terminal, and further react the remaining functional group with a compound having both a functional group reactive with the remaining functional group and a reactive group.

The above method [1] can produce, for example, a polyester prepolymer having a hydroxyl group, a polyester prepolymer having a carboxyl group, a polyester prepolymer having an acid halide group, an epoxy resin prepolymer having a hydroxyl group, an epoxy resin prepolymer having an epoxy group, a polyurethane prepolymer having a hydroxyl group, and a polyurethane prepolymer having an isocyanate group. For example, a polyester prepolymer having a hydroxyl group can be obtained by reacting a polyol (1) with a polycarboxylic acid (2) with the equivalent ratio [OH]/[COOH] of hydroxyl groups [OH] from the polyol (1) to carboxyl groups [COOH] from the polycarboxylic acid (2) being 2/1 to 1/1, 1.5/1 to 1/1, or 1.3/1 to 1.02/1.

In the above method [2], for example, a prepolymer having an isocyanate group, a prepolymer having a blocked isocyanate group, a prepolymer having an epoxy group, and a prepolymer having an acid anhydride group can be produced by reacting the prepolymer produced by the method [1] with a polyisocyanate, a blocked polyisocyanate, a polyepoxide, and a poly(acid anhydride), respectively. For example, a polyester prepolymer having an isocyanate group can be obtained by reacting a polyester having a hydroxyl group with a polyisocyanate with the equivalent ratio [NCO]/[OH] of isocyanate groups [NCO] from the polyisocyanate to hydroxyl groups [OH] from the polyester having hydroxyl group being 5/1 to 1/1, 4/1 to 1.2/1, or 2.5/1 to 1.5/1.

In some embodiments, the average number of reactive groups included in one molecule of the prepolymer (α) is 1 or more, 1.5 to 3, or 1.8 to 2.5. Within the above range, the reaction product of the prepolymer (α) having a reactive group with the hardener (β) has a relatively high molecular weight. In some embodiments, the prepolymer (α) having a reactive group has a number average molecular weight (Mn) of 500 to 30,000, 1,000 to 20,000, or 2,000 to 10,000. In some embodiments, the prepolymer (α) having a reactive group has a weight average molecular weight (Mw) of 1,000 to 50,000, 2,000 to 40,000, or 4,000 to 20,000. In some embodiments, the prepolymer (α) having a reactive group has a viscosity of 2,000 poise or less, or 1,000 poise or less, at 100° C. When the viscosity is 2,000 poise or less, the resin particle (C) having a narrow size distribution can be obtained with use of a small amount of organic solvents.

The compound (β1) having an active hydrogen group may be, for example, a polyamine (β1a) which may be blocked with a releasable compound, a polyol (β1b), a polymercaptan (β1c), and water (β1d). In some embodiments, a polyamine (β1a) which may be blocked with a releasable compound, a polyol (β1b), or water (β1d) is used. In some embodiments, a polyamine (β1a) which may be blocked with a releasable compound or water (β1d) is used. In some embodiments, a blocked polyamine or water (β1d) is used. The polyamine (β1a) may be, for example, a polyamine (16). The polyamine (β1a) may be, for example, 4,4'-diaminodiphenylmethane, xylylenediamine, isophoronediamine, ethylenediamine, diethylenetriamine, triethylenetetramine, or a mixture thereof.

The polyamine (β1a) which is blocked with a releasable compound may be, for example, a ketimine compound obtained from a polyamine and a ketone having 3 to 8 carbon atoms (e.g., acetone, methyl ethyl ketone, methyl isobutyl ketone), an aldimine compound obtained from an aldehyde compound having 2 to 8 carbon atoms (e.g., formaldehyde, acetaldehyde), an enamine compound, or an oxazoline compound.

The polyol (β1b) may be, for example, the diol (11) or the polyol (12). In some embodiments, the diol (11) alone or a mixture of the diol (11) with a small amount of the polyol (12) is employed. The polymercaptan (β1c) may be, for example, ethylenedithiol, 1,4-butanedithiol, or 1,6-hexanedithiol.

A reaction terminator (βs) may be optionally used in combination with the compound (β1) having an active hydrogen group. Combination use of the reaction terminator (βs) and the compound (β1) having an active hydrogen group at a specific ratio properly adjusts the molecular weight of the resulting resin. Specific examples of the reaction terminator (βs) include, but are not limited to, monoamines (e.g., diethylamine, dibutylamine, laurylamine, monoethanolamine, diethanolamine), blocked monoamines (e.g., ketimine compounds), monools (e.g., methanol, ethanol, isopropanol, butanol, phenol), monomercaptans (e.g., butylmercaptan, laurylmercaptan), monoisocyanates (e.g., lauryl isocyanate, phenyl isocyanate), and monoepoxides (e.g., butyl glycidyl ether).

In the above combination (2), the active hydrogen group (α2) in the prepolymer (α) may be, for example, an amino group (α2a), a hydroxyl group (α2b) (e.g., an alcoholic hydroxyl group, a phenolic hydroxyl group), a mercapto group (α2c), a carboxyl group (α2d), or an organic group (α2e) blocked with a releasable compound. In some embodiments, an amino group (α2a), a hydroxyl group (α2b), or an organic group (α2e) which is an amino group blocked with a releasable compound is employed. In some embodiments, a hydroxyl group (α2b) is employed. Specific examples of the organic group (α2e) which is an amino group blocked with a releasable compound include, for example, those of the polyamine (β1a) which may be blocked with a releasable compound.

The compound (β2) reactive with an active hydrogen group may be, for example, a polyisocyanate (β2a), a polyepoxide (β2b), a polycarboxylic acid (β2c), a polycarboxylic acid anhydride (β2d), or a poly acid halide (β2e). In some embodiments, a polyisocyanate (β2a) or a polyepoxide (β2b) is employed. In some embodiments, a polyisocyanate (β2a) is employed.

The polyisocyanate (β2a) may be, for example, a polyisocyanate (15). The polyepoxide (β2b) may be, for example, a polyepoxide (19).

The polycarboxylic acid (β2c) may be, for example, a dicarboxylic acid (β2c-1) or a polycarboxylic acid (β2c-2) having 3 or more valences. In some embodiments, the dicarboxylic acid (β2c-1) alone or a mixture of the dicarboxylic acid (β2c-1) with a small amount of the polycarboxylic acid (β2c-2) having 3 or more valences is employed. The dicarboxylic acid (β2c-1) may be, for example, a dicarboxylic acid (13). The polycarboxylic acid (β2c-2) having 3 or more valences may be, for example, a polycarboxylic acid (5).

The polycarboxylic acid anhydride (β2d) may be, for example, a pyromellitic acid anhydride. The poly acid halide (β2e) may be, for example, an acid halide (e.g., acid chloride, acid bromide, acid iodide) of the polycarboxylic acid (β2c). The reaction terminator (βs) may be optionally used in combination with the compound (β2) reactive with an active hydrogen group.

In some embodiments, the ratio [α]/[β] of the equivalent amount [α] of reactive groups in the prepolymer (α) to the equivalent amount [β] of active hydrogen groups in the hardener (β) is 1/2 to 2/1, 1.5/1 to 1/1.5, or 1.2/1 to 1/1.2. The water (β1d) as the hardener (β) is regarded as a divalent compound having an active hydrogen group.

The resin (b2) is obtained by reacting the precursor (b0), i.e., by reacting the prepolymer (α) having a reactive group with the hardener (β), in an aqueous medium. As a result, the resin (b2) is included in the resin particle (B) and further included in the resin particle (C). In some embodiments, the resin (b2) obtained by reacting the prepolymer (α) having a reactive group with the hardener (β) has a weight average molecular weight of 3,000 or more, 3,000 to 10,000, or 5,000 to 1,000,000.

In some embodiments, a dead polymer that is unreactive with either the prepolymer (α) having a reactive group or the hardener (β), such as the straight-chain polyester resin (b1), is added to the reaction system in which the prepolymer (α) having a reactive group is reacted with the hardener (β) in an aqueous medium. In such embodiments, the resulting resin is a mixture of the straight-chain polyester resin (b1) and the resin (b2) obtained from a reaction between the prepolymer (α) having a reactive group and the hardener (β).

According to an embodiment, the used amount of the aqueous dispersion (W) is 50 to 2,000 parts by weight, or 100 to 1,000 parts by weight, based on 100 parts by weight of the resin (b). When the used amount of the aqueous dispersion (W) is 50 parts by weight or more, dispersion condition is good. The used amount of the aqueous dispersion (W) of 2,000 parts by weight or less results in reduction of cost.

The resin particle (C) can be obtained by mixing an aqueous dispersion (W) of the resin particle (A) including the resin (a) with an organic solvent solution or dispersion (O1) of the resin (b) or an organic solvent solution or dispersion (O2) of the precursor (b0) of the resin (b) so that the organic solvent solution or dispersion (O1) or (O2) is dispersed in the aqueous dispersion (W). The precursor (b0) is subject to a reaction for producing the resin (b2). As a result, an aqueous dispersion (X) of the resin particle (C), having a configuration in which the resin (a) is adhered to a surface of the resin particle (B) including the resin (b), is obtained. The resin particle (C) is isolated by removing the aqueous medium from the aqueous dispersion (X). The resin (a) adhered to a surface of the resin particle (B) may take the form of either the resin particle (A) or the covering layer (P). Whether the resin (a) takes the form of the resin particle (A) or the covering layer (P) depends on the glass transition temperature of the resin (a) and/or manufacturing conditions (e.g., solvent removing temperature) of the resin particle (C).

When the resin particle (C) is obtained by the above-described method (I), the particle shape and surface property of the resin particle (C) can be controlled by varying the solubility parameter difference between the resins (a) and (b) or the molecular weight of the resin (a). When the solubility parameter difference between the resins (a) and (b) is relatively small, it is likely that the resulting particles have irregular shapes and smooth surfaces. When the solubility parameter difference between the resins (a) and (b) is relatively large, it is likely that the resulting particles have spherical shapes and rough surfaces. When the molecular weight of the resin (a) is relatively large, it is likely that the resulting particles have rough surfaces. When the molecular weight of the resin (a) is relatively small, it is likely that the resulting particles have smooth surfaces. When the solubility parameter difference between the resins (a) and (b) is too small or large, it may be difficult to produce particles. When the molecular weight of the resin (a) is too small, it may be difficult to produce particles. In some embodiments, the solubility parameter difference between the resins (a) and (b) is 0.01 to 5.0, 0.1 to 3.0, or 0.2 to 2.0.

When the resin particle (C) is obtained by the above-described method (II), the shape of the resin particle (C) largely depends on the shape of the resin particle (B), and the resin particle (C) has substantially the same shape as the resin particle (B). However, even in a case in which the resin particle (B) has an irregular shape, the resin particle (C) can have a spherical shape by coating the resin particle (B) with a large amount of the coating agent (W').

According to an embodiment, the resin particle (C) includes 0.01 to 60% by weight of the resin particle (A) or covering layer (P) including the resin (a) and 40 to 99.99% of the resin particle (B) including the resin (b), in view of particle diameter distribution and storage stability of the resin particle (C). In some embodiments, the resin particle (C) includes 0.1 to 50% by weight of the resin particle (A) or covering layer (P) and 50 to 99.9% of the resin particle (B). In some embodiments, the resin particle (C) includes 1 to 45% by weight of the resin particle (A) or covering layer (P) and 55 to 99% of the resin particle (B). When the amount of the resin particle (A) or covering layer (P) including the resin (a) is 0.01% by weight or more, blocking resistance is good. When the amount of the resin particle (A) or covering layer (P) including the resin (a) is 60% by weight or less, low-temperature fixability is good.

According to an embodiment, 5% or more, 30% or more, 50% or more, or 80% or more of the surface of the resin particle (B) is covered with the resin particle (A) or covering layer (P) including the resin (a), in view of particle diameter distribution, powder fluidity, and storage stability of the resin particle (C). The surface coverage of the resin particle (C) can be determined by analyzing a scanning electron microscope (SEM) image of the particle (C) according to the following formula.

$$\text{Surface coverage}(\%)=(\text{Area covered with resin particle}(A)\text{ or covering layer}(P))/[(\text{Area covered with resin particle}(A)\text{ or covering layer}(P))+(\text{Area exposing resin particle}(B))]\times 100$$

According to an embodiment, the variation coefficient of the volume distribution of the resin particle (C) is 30% or less, or 0.1 to 15%, in view of particle diameter distribution of the resin particle (C). According to an embodiment, the ratio of the volume average particle diameter to the number average particle diameter of the resin particle (C) is 1.0 to 1.4, or 1.0 to 1.3, in view of particle diameter distribution of the resin particle (C). According to an embodiment, the resin particle (C) has a volume average particle diameter of 0.1 to 16 μm. In some embodiments, the upper limit of the volume average particle diameter of the resin particle (C) is 11 μm or 9 μm and the lower limit thereof is 0.5 μm or 1 μm. The volume average particle diameter and number average particle diameter can be simultaneously measured by an instrument Multisizer III (from Beckman Coulter, Inc.).

Concavities and convexities may be formed on the surface of the resin particle (C), if desired, by varying the particle diameters of the resin particle (A) and/or resin particle (B), or the surface coverage of the resin particle (B) with the covering layer (P). In some embodiments, the resin particle (C) has a BET specific surface area of 0.5 to 5.0 $m^2/g$, in view of powder fluidity. BET specific surface area can be measured with a surface area meter QUANTASORB (from Yuasa Ionics Co., Ltd.) using a mixed gas of He/Kr (9.9/0.1 by vol) as a measurement gas and nitrogen gas a detention gas. In some embodiments, the resin particle (C) has a center line average surface roughness Ra of 0.01 to 0.8 μm, in view of powder fluidity. Ra is an arithmetical mean value of absolute deviation values between a surface profile curve and the center line. Ra can be measured with a scanning probe microscopic system (from TOYO Corporation).

In some embodiments, the resin particle (C) has a spherical shape in view of power fluidity and melt leveling property. In such embodiments, the resin particle (B) may also have a spherical shape. In some embodiments, the resin particle (C) has an average circularity of 0.95 to 1.00, 0.96 to 1.0, or 0.97 to 1.0. The average circularity is obtained by optically detecting projected images of particles, dividing the peripheral length of the circle having the same area as each projected image by the peripheral length of the projected image, and averaging all the data. The average circularity can be measured by a flow-type particle image analyzer FPIA-2000 (from Sysmex Corporation) as follows. Place 100 to 150 mL of water from which solid impurities have been removed in a container and add 0.1 to 0.5 mL of a surfactant (DRYWELL from FUJIFILM Corporation) and 0.1 to 9.5 g of a sample thereto. Subject the resulting suspension to a dispersion treatment with an ultrasonic disperser (Ultrasonic Cleaner Model VS-150 from VELVO-CLEAR) for about 1 to 3 minutes. Subject the suspension including 3,000 to 10,000 particles per micro-liter to a measurement of shape distribution of the sample.

According to an embodiment, the toner includes a charge controlling agent.

Specific examples of usable charge controlling agents include, but are not limited to, nigrosine dyes, azine dyes having an alkyl group having 2 to 16 carbon atoms described in Examined Japanese Application Publication No. 42-1627, the disclosures thereof being incorporated herein by reference; basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000)) and lake pigments thereof; quaternary ammonium salts (e.g., C.I. Solvent Black 8 (C.I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478, the disclosures thereof being incorporated herein by reference; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385, the disclosures thereof being incorporated herein by reference; sulfonated copper phthalocyanine pigments; organic boron salts; fluorine-containing quaternary ammonium salts; and calixarene compounds. Two or more of these materials can be used in combination. When the toner includes a colorant other than black, a whitish charge controlling agent, such as a metal salt of a salicylic acid derivative, may be used so that the colorant can express its color.

In some embodiments, the content of the charge controlling agent is 0.01 to 2 parts by weight or 0.02 to 1 part by weight based on 100 parts of the binder resin. When the content of the charge controlling agent is 0.01 parts by weight or more, good charge controllability is provided. When the content of charge controlling agent is 2 parts by weight or less, the toner is not excessively charged nor excessively electrostatically attracted to a developing roller, preventing deterioration of fluidity and image density while keeping good charge controllability.

According to an embodiment, the toner includes a layered inorganic mineral in which at least a part of interlayer ions are modified with organic ions (hereinafter "modified layered inorganic mineral"). Specific examples of such modified layered inorganic minerals include, but are not limited to, smectite-based materials modified with organic cations. Metal anions can be introduced to a layered inorganic mineral by replacing a part of divalent metals with trivalent metals. In this case, since the metal anions have high hydrophilicity, at least a part of the introduced metal anions may be modified with organic anions.

Specific materials usable as organic cation modifying agents include, but are not limited to, quaternary alkyl ammonium salts, phosphonium salts, and imidazolium salts. In one or more embodiments, quaternary alkyl ammonium salts are used. Specific examples of the quaternary alkyl ammonium salts include, but are not limited to, trimethyl stearyl ammonium, dimethyl stearyl benzyl ammonium, and oleylbis(2-hydroxyethyl)methyl ammonium.

Specific materials usable as organic anion modifying agents include, but are not limited to, sulfates, sulfonates, carboxylates, and phosphates having a branched, non-branched, or cyclic alkyl (C1-C44), alkenyl (C1-C22), alkoxy (C8-C32), hydroxyalkyl (C2-C22), ethylene oxide, or propylene oxide. In one or more embodiments, carboxylic acids having an ethylene oxide skeleton are used.

The modified layered inorganic mineral has proper hydrophobicity due to the modification by the organic ion. The organic solvent solution or dispersion (O1) and (O2) including the modified layered inorganic mineral express non-Newtonian viscosity, which is capable of controlling or varying the resulting toner shape. In some embodiments, the content of the modified layered inorganic mineral in the organic solvent solution or dispersion (O1) and (O2) is 0.05 to 10% by weight or 0.05 to 5% by weight.

Specific examples of the modified layered inorganic minerals include, but are not limited to, montmorillonite, bentonite, hectorite, attapulgite, sepiolite, and mixtures thereof. In some embodiments, an organic-modified montmorillonite or bentonite is used. They can easily control viscosity of the organic solvent solution or dispersion (O1) and (O2) at a small amount without adversely affecting other toner properties.

Specific examples of commercially available organic-cation-modified layered inorganic minerals include, but are not limited to, quaternium 18 bentonite such as BENTONE® 3, BENTONE® 38, and BENTONE® 38V (from Rheox), TIXOGEL VP (from United Catalyst), and CLAYTONE® 34, CLAYTONE® 40, and CLAYTONE® XL (from Southern Clay Products); stearalkonium bentonite such as BENTONE® 27 (from Rheox), TIXOGEL LG (from United Catalyst), and CLAYTONE® AF and CLAYTONE® APA (from Southern Clay Products); and quaternium 18/benzalkonium bentonite such as CLAYTONE® HT and CLAYTONE® PS (from Southern Clay Products). In some embodiments, CLAYTONE® AF or CLAYTONE® APA is used. Specific examples of commercially available organic-anion-modified layered inorganic minerals include, but are not limited to, HITENOL 330T (from Dai-ichi Kogyo Seiyaku Co., Ltd.) obtainable by modifying DHT-4A (from Kyowa Chemical Industry Co., Ltd.) with an organic anion represented by the following formula:

$$R^1(OR^2)nOSO_3M$$

wherein $R^1$ represents an alkyl group having 13 carbon atoms, $R^2$ represents an alkylene group having 2 to 6 carbon atoms, n represents an integer of from 2 to 10, and m represents a monovalent metal element.

According to an embodiment, the toner includes a colorant such as a pigment and a dye.

Specific examples of usable yellow colorants include, but are not limited to, Cadmium Yellow, Mineral Fast Yellow, Nickel Titanium Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake.

Specific examples of usable orange colorants include, but are not limited to, Molybdenum Orange, Permanent Orange GTR, Pyrazolone Orange, Vulcan Orange, Indanthrene Brilliant Orange RK, Benzidine Orange G, and Indanthrene Brilliant Orange GK.

Specific examples of usable red colorants include, but are not limited to, colcothar, Cadmium Red, Permanent Red 4R, Lithol Red, Pyrazolone Red, Watching Red calcium salt, Lake Red D, Brilliant Carmine 6B, Eosin Lake, Rhodamine Lake B, Alizarin Lake, and Brilliant Carmine 3B.

Specific examples of usable violet colorants include, but are not limited to, Fast Violet B and Methyl Violet Lake.

Specific examples of usable blue colorants include, but are not limited to, Cobalt Blue, Alkali Blue, Victoria Blue Lake, Phthalocyanine Blue, metal-free Phthalocyanine Blue, partially-chlorinated Phthalocyanine Blue, Fast Sky Blue, and Indanthrene Blue BC.

Specific examples of usable green colorants include, but are not limited to, Chrome Green, chromium oxide, Pigment Green B, and Malachite Green.

Specific examples of usable black colorants include, but are not limited to, azine dyes, metal salt azine dyes, metal oxides, and complex metal oxides, such as carbon black, oil furnace black, channel black, lamp black, acetylene black, and aniline black.

Two or more of these colorants can be used in combination.

In some embodiments, the content of the colorant in the toner is 1 to 15% by weight or 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

The colorant can be combined with a resin to be used as a master batch. Specific examples of usable resins include, but are not limited to, polyester, polymers of styrene or styrene derivatives, styrene-based copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these materials can be used in combination. In some embodiments, a polymer of styrene or a styrene derivative is used.

Specific examples of usable polymers of styrene or styrene derivatives include, but are not limited to, polystyrene, poly (p-chlorostyrene), and polyvinyl toluene. Specific examples of usable styrene-based copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading a resin and a colorant while applying a high shearing force. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

According to an embodiment, the toner includes a release agent. Specific examples of usable release agents include, but are not limited to, free-fatty-acid-free carnauba wax, polyethylene wax, montan wax, oxidized rice wax, and combinations thereof. In some embodiments, a microcrystalline carnauba wax having an acid value of 5 or less, which can be dispersed in the binder resin with a dispersion diameter of 1 μm or less, is used. In some embodiments, a microcrystalline montan wax, obtained by purifying a mineral, having an acid value of 5 to 14 is used. In some embodiments, an oxidized rice wax, obtained by oxidizing a rice bran wax with air, having an acid value of 10 to 30 is used. These waxes can be finely dispersed in the resin, which can provide a toner having a good combination of hot offset resistance, transferability, and durability. Two or more kinds of the above waxes can be used in combination.

Specific materials usable as the release agent further include, but are not limited to, solid silicone wax, higher fatty acid higher alcohol, montan ester wax, polyethylene wax, polypropylene wax, and combinations thereof.

In some embodiments, the release agent has a glass transition temperature (Tg) of 70 to 90° C. When Tg is less than 70° C., heat-resistant storage stability of the toner may be poor. When Tg is greater than 90° C., cold-offset resistance of the toner may be poor, i.e., the toner may not be releasable at low temperatures and undesirably winds around a fixing member. In some embodiments, the content of the release agent in the toner is 1 to 20% by weight or 3 to 10% by weight. When the content of the release agent is less than 1% by weight, offset resistance of the toner may be poor. When the content of the release agent is greater than 20% by weight, transferability and durability of the toner may be poor.

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Two or more of these materials can be used in combination.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

In some embodiments, the content of the charge controlling agent is 0.1 to 10 parts by weight, or 0.2 to 5 parts by weight, based on 100 parts of the binder resin. When the content of the charge controlling agent is less than 0.1 parts by weight, it is difficult to control charge of the toner. When the content of charge controlling agent is greater than 10 parts by weight, the toner may be excessively charged and excessively electrostatically attracted to a developing roller, resulting in poor fluidity of the developer and low image density.

The toner may further include inorganic fine particles, cleanability improving agents, magnetic materials, etc.

Inorganic fine particles are externally added to the surface of the toner and give fluidity, developability, and chargeability to the toner. Specific examples of usable inorganic fine particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of these materials can be used in combination.

In some embodiments, the inorganic fine particles have a primary particle diameter of 5 nm to 2 μm or 5 nm to 500 nm.

In some embodiments, the content of the inorganic fine particles in the toner is 0.01 to 5.0% by weight or 0.01 to 2.0% by weight.

The surface of the inorganic fine particles may be surface-treated with a fluidity improving agent. Surface-treated inorganic fine particles have an improved hydrophobicity which prevents deterioration of fluidity and chargeability even under high-humidity conditions. Specific materials usable as the fluidity improving agent include, but are not limited to, silane coupling agents, silylation agents, silane coupling agents having a fluorinated alkyl group, organic titanate coupling agents, aluminum coupling agents, silicone oils, and modified silicone oils. The above-described silica and titania particles can also be hydrophobized with the fluidity improving agent.

Cleanability improving agents are adapted to improve removability of toner from a photoreceptor or primary transfer medium. Specific materials usable as the cleanability improving agent include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, the fine particles of polymers have a narrow size distribution and a volume average particle diameter of 0.01 to 1 μm.

Specific examples of usable magnetic materials include, but are not limited to, iron powder, magnetite, and ferrite. In some embodiments, a magnetic material having a whitish color is used.

According to an embodiment, the volume average particle diameter (Dv) of the toner is 3 to 8 μm and the ratio (Dv/Dn) of the volume average particle diameter (Dv) to the number average particle diameter (Dn) is 1.00 to 1.25. Such a toner has a good combination of heat-resistant storage stability, low-temperature fixability, hot offset resistance, and image gloss. When the toner is used for a two-component developer, the average toner size may not vary very much although consumption and supply of toner particles are repeated. Thus, the two-component developer reliably provides stable developability for an extended period of time. When the toner is used for a one-component developer, the average toner size may not vary very much although consumption and supply of toner particles are repeated. Additionally, toner particles may not adhere or fix to a developing roller or a toner layer regulating blade. Thus, the one-component developer reliably provides stable developability and image quality for an extended period of time.

Generally, the smaller the particle diameter of toner, the better the image resolution and image quality but the worse transferability and cleanability. When the volume average particle diameter is less than 3 μm, such toner particles may undesirably fuse on the surfaces of carrier particles and degrade charging ability of the carrier particles after a long-term agitation in a developing device, when used for a two-component developer. Such toner particles may also fuse on a developing roller or a toner layer regulator, when used for a one-component developer.

When the volume average particle diameter (Dv) is greater than 8 μm or Dv/Dn is greater than 1.25, it may be difficult to produce high-resolution and high-quality images. Moreover, the average particle diameter of such toner particles in a developer may largely vary upon consumption and supply of the toner particles.

Volume average particle diameter (Dv) and number average particle diameter (Dn) of toner can be measured by a particle size analyzer MULTISIZER III (from Beckman Coulter, Inc.) having an aperture size of 100 μm and an analysis software program Beckman Coulter Multisizer 3 Version 3.51 as follows. First, charge a 100-mL glass beaker with 0.5 mL of a 10% by weight aqueous solution of an alkylbenzene sulfonate (NEOGEN SC-A from Dai-ichi Kogyo Seiyaku Co., Ltd.). Add 0.5 g of a toner to the beaker and mix with a micro spatula. Further add 80 mL of ion-exchange water to the beaker. Subject the resulting dispersion to a dispersion treatment for 10 minutes using an ultrasonic disperser (W-113 MK-II from Honda Electronics). Subject the dispersion to a measurement by the MULTISIZER III using a measuring solution ISOTON III (from Beckman Coulter, Inc.). During the measurement, the dispersion is dropped so that the sample concentration becomes 8±2%. In terms of measurement reproducibility, it is important that the sample concentration is kept at 8±2%.

The toner may be manufactured by, for example, a pulverization method; a polymerization method in which monomers are directly polymerized in an aqueous phase (e.g., a suspension polymerization method, an emulsion polymerization method); a polyaddition method in which a prepolymer having an isocyanate group is directly elongated and/or cross-linked with an amine in an aqueous phase; a method in which toner components are dissolved in a solvent, the solvent is removed, and the toner components mixture is pulverized; and a melt spraying method.

In the pulverization method, toner components, such as a binder resin, a colorant, and a release agent, are melt-kneaded, the melt-kneaded mixture is pulverized into particles, and the particles are classified by size.

Toner particles obtained by the pulverization method may be subjected to shape control by application of mechanical impact force so that the average circularity is increased. Mechanical impact force can be applied from an instrument such as HYBRIDIZER and MECHANOFUSION.

In the pulverization method, first, toner components are mixed and the mixture is melt-kneaded by a melt-kneader.

Usable melt-kneaders include single-axis or double-axis continuous kneaders and roll mill batch kneaders. Specific examples of commercially-available melt-kneaders include, but are not limited to, TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KOKNEADER (from Buss Corporation). The melt-kneading conditions are adjusted so as not to cut molecular chains of the binder resin. For example, when the melt-kneading temperature is too much higher than the softening point of the binder resin, molecular chains may be significantly cut. When the melt-kneading temperature is too much lower than the softening point of the binder resin, the raw materials may not be sufficiently kneaded.

Next, the resulting kneaded product is pulverized. The kneaded product may be first pulverized into coarse particles and subsequently pulverized into fine particles. Specific pulverization methods include, for example, a method in which the kneaded product is brought into collision with a collision plate in a jet stream, a method in which particles are brought into collision with each other in a jet stream, and a method in which the kneaded product is pulverized within a narrow gap between mechanically rotating rotor and stator.

The resulting particles are classified by size, and particles within a predetermined size range are collected. Undesired fine particles are removed by cyclone separation, decantation, or centrifugal separation, for example.

Thereafter, the particles are further classified in an airflow by centrifugal force to obtain mother toner particles having a predetermined size.

In the suspension polymerization method, toner components such as a colorant and a release agent are dispersed in an oil-soluble polymerization initiator and polymerizable monomers, and the resulting mixture is emulsified in an aqueous medium containing a surfactant and/or a solid dispersant. The monomers are then subjected to a polymerization reaction to produce toner particles. The toner particles are then subjected to a wet treatment in which inorganic fine particles are adhered to the surfaces of the toner particles. Excessive residual surfactants, if any, may be removed from the toner particles before the wet treatment.

When the polymerizable monomers include an acid (e.g., acrylic acid, methacrylic acid, α-cyanoacrylic acid, α-cyanomethacrylic acid, itaconic acid, crotonic acid, fumaric acid, maleic acid, maleic anhydride), an amide (e.g., acrylamide, methacrylamide, diacetone acrylamide) or a methylol compound thereof, vinyl pyridine, vinyl pyrrolidone, vinyl imidazole, ethylene imine, an amino-group-containing acrylate or methacrylates, a functional group can be introduced to the resulting toner particles.

Alternatively, when a dispersant having an acidic or basic group is used, such a dispersant can be adsorbed to the surfaces of the resulting toner particles so that a functional group is introduced to the toner particles.

In the emulsion polymerization method, a water-soluble polymerization initiator and polymerizable monomers are emulsified in water in the presence of a surfactant. The monomers are then subjected to a polymerization reaction to prepare a latex. On the other hand, toner components such as a colorant and a release agent are dispersed in an aqueous medium to obtain a water dispersion of the toner components. The water dispersion and the latex are mixed and the dispersoids are aggregated until the resulting aggregations have a size similar to the toner size. The aggregations are heated so that the dispersoids are fused with each other to form toner particles. The toner particles are then subjected to a wet treatment in which inorganic fine particles are adhered to the surfaces of the toner particles. A functional group can be introduced to the resulting toner particles when the above-described polymerizable monomers usable for the suspension polymerization are used in preparing the latex.

In one or more embodiments, the toner is prepared by dissolving or dispersing toner components, including a binder resin, a colorant, and a release agent, in an organic solvent to prepare a toner components liquid; and emulsifying or dispersing the toner components liquid in an aqueous medium. In some embodiments, the toner is prepared by reacting a polyester resin having a functional group reactive with an active hydrogen group, such as an isocyanate group, with a compound having an active hydrogen group in an aqueous medium. More specifically, in some embodiments, the toner is prepared by the following steps (1) to (6).

(1) Preparation of Toner Components Liquid:

In the first step, a toner components liquid is prepared by dissolving or dispersing toner components in an organic solvent. Specific examples of usable organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. In some embodiments, an ester solvent is used because it dissolves polyester resins well. In some embodiments, ethyl acetate is used because it is easily removable.

In some embodiments, the used amount of the organic solvent is 40 to 300 parts by weight, 60 to 140 parts by weight, or 80 to 120 parts by weight, base on 100 parts by weight of the toner components.

(2) Preparation of Aqueous Medium:

In the second step, an aqueous medium is prepared by dispersing resin particles in an aqueous solvent. The added amount of the resin particles may be, for example, 0.5 to 10% by weight.

Usable aqueous solvents include, but are not limited to, water and water-miscible solvents. Two or more kinds of solvents can be used in combination. In one or more embodiments, water is used. Specific examples of usable water-miscible solvents include, but are not limited to, alcohols (e.g., methanol, isopropanol, ethylene glycol), dimethylformamide, tetrahydrofuran, cellosolves, and lower ketones (e.g., acetone, methyl ethyl ketone).

The resin particles are prepared from a resin capable of forming an aqueous dispersion thereof. Such resins include thermoplastic and thermosetting resins such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. In some embodiments, a vinyl resin, a polyurethane resin, an epoxy resin, a polyester resin, or a combination thereof is used because they are easy to form an aqueous dispersion of fine spherical particles thereof. The vinyl resin can be obtained from a homopolymerizaiton or copolymerization of vinyl monomers. Specific examples of the vinyl resin include, but are not limited to, styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic acid copolymer, styrene-acrylic acid copolymer, and styrene-methacrylic acid copolymer.

The resin particles can be also obtained from monomers having two or more unsaturated groups. Specific examples of such monomers having two or more unsaturated groups include, but are not limited to, a sodium salt of sulfuric ester of ethylene oxide adduct of methacrylic acid, divinylbenzene, and 1,6-hexanediol diacrylate.

The resin particles may be obtained in the form of aqueous dispersion. An aqueous dispersion of resin particles can be prepared by the following procedures (a) to (h), for example. (a) An aqueous dispersion of a vinyl resin is obtainable by directly subjecting raw materials including a vinyl monomer to a suspension polymerization, an emulsion polymerization, a seed polymerization, or a dispersion polymerization. (b) An aqueous dispersion of a polyaddition or polycondensation resin (e.g., polyester resin, polyurethane resin, epoxy resin) is obtainable by dispersing a precursor (e.g., monomer, oligomer) of the resin or a solution thereof in an aqueous medium in the presence of a dispersant, and curing the precursor by application of heat or addition of a curing agent. (c) An aqueous dispersion of a polyaddition or polycondensation resin (e.g., polyester resin, polyurethane resin, epoxy resin) is obtainable by dissolving an emulsifier in a precursor (e.g., monomer, oligomer) of the resin or a solution (preferably in a liquid state, or which may be liquefied by application of heat) thereof, and further adding water thereto to cause phase-transfer emulsification. (d) An aqueous dispersion of a resin produced by a polymerization reaction (e.g., addition polymerization, ring-opening polymerization, polyaddition, addition condensation, polycondensation) is obtainable by pulverizing the resin into particles by a mechanical rotary pulverizer or a jet pulverizer, classifying the particles by size to collect desired-size particles, and dispersing the collected particles in an aqueous medium in the presence of a dispersant. (e) An aqueous dispersion of a resin produced by a polymerization reaction (e.g., addition polymerization, ring-opening polymerization, polyaddition, addition condensation, polycondensation) is obtainable by dissolving the resin in a solvent, spraying the resulting resin solution to form resin particles, and dispersing the resin particles in an aqueous medium in the presence of a dispersant. (f) An aqueous dispersion of a resin produced by a polymerization reaction (e.g., addition polymerization, ring-opening polymerization, polyaddition, addition condensation, polycondensation) is obtainable by dissolving the resin in a solvent and further adding a poor solvent to the resulting resin solution, or dissolving the resin in a solvent by application of heat and cooling the resulting resin solution, to precipitate resin particles, removing the solvents to isolate the resin particles, and dispersing the resin particles in an aqueous medium in the presence of a dispersant. (g) An aqueous dispersion of a resin produced by a polymerization reaction (e.g., addition polymerization, ring-opening polymerization, polyaddition, addition condensation, polycondensation) is obtainable by dissolving the resin in a solvent, dispersing the resulting resin solution in an aqueous medium in the presence of a dispersant, and removing the solvent by application of heat and/or reduction of pressure. (h) An aqueous dispersion of a resin produced by a polymerization reaction (e.g., addition polymerization, ring-opening polymerization, polyaddition, addition condensation, polycondensation) is obtainable by dissolving the resin in a solvent, dissolving an emulsifier in the resulting resin solution, and adding water thereto to cause phase-transfer emulsification.

The aqueous medium may include a dispersant for the purpose of stabilizing liquid droplets formed when the toner components liquid is emulsified in the aqueous medium, to obtain toner particles with a desired shape and a narrow particle size distribution. The dispersant may be, for example, a surfactant, a poorly-water-soluble inorganic compound, or a polymeric protection colloid. Two or more of these materials can be used in combination. Usable surfactants include anionic surfactants, cationic surfactants, nonionic surfactants, and ampholytic surfactants.

Specific examples of usable anionic surfactants include, but are not limited to, alkylbenzene sulfonate, α-olefin sulfonate, and phosphate. In some embodiments, anionic surfactants having a fluoroalkyl group is used. Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11) oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates. Specific examples of commercially available such anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3 M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of usable cationic surfactants include, but are not limited to, amine salt type surfactants and quaternary ammonium salt type surfactants. Specific examples of the amine salt type surfactants include, but are not limited to, alkylamine salts, amino alcohol fatty acid derivatives, polyamine fatty acid derivatives, and imidazoline. Specific examples of the quaternary ammonium salt type surfactants include, but are not limited to, alkyl trimethyl ammonium salt, dialkyl dimethyl ammonium salt, alkyl dimethyl benzyl ammonium salt, pyridinium salt, alkyl isoquinolinium salt, and benzethonium chloride. Additionally, aliphatic primary, secondary, and tertiary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts are also usable as cationic surfactants. Specific examples of commercially available such cationic surfactants having a fluoroalkyl group include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Specific examples of usable nonionic surfactants include, but are not limited to, fatty acid amide derivatives and polyol derivatives.

Specific examples of usable ampholytic surfactants include, but are not limited to, alanine, dodecyl bis(aminoethyl)glycine, bis(octylaminoethyl)glycine, and N-alkyl-N,N-dimethyl ammonium betaine.

Specific examples of usable poorly-water-soluble inorganic compounds include, but are not limited to, tricalcium phosphate, calcium carbonate, titanium oxide, colloidal silica, and hydroxyapatite.

Specific examples of usable polymeric protection colloids include, but are not limited to, homopolymers and copolymers obtained from monomers, such as acid monomers, acrylate and methacrylate monomers having hydroxyl group, vinyl alcohol ether monomers, vinyl carboxylate monomers, monomers having amide bond and methylol compounds thereof, acid chloride monomers, and/or monomers containing nitrogen or a nitrogen-containing heterocyclic ring; polyoxyethylene resins; and celluloses.

Specific examples of the acid monomers include, but are not limited to, acrylic acid, methacrylic acid, α-cyanoacrylic acid, α-cyanomethacrylic acid, itaconic acid, crotonic acid, fumaric acid, maleic acid, and maleic anhydride.

Specific examples of the acrylate and methacrylate monomers having hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide.

Specific examples of the vinyl ether monomers include, but are not limited to, vinyl methyl ether, vinyl ethyl ether, and vinyl propyl ether.

Specific examples of the vinyl carboxylate monomers include, but are not limited to, vinyl acetate, vinyl propionate, and vinyl butyrate.

Specific examples of the monomers having amide bond include, but are not limited to, acrylamide, methacrylamide, and diacetone acrylamide.

Specific examples of the acid chloride monomers include, but are not limited to, acrylic acid chloride and methacrylic acid chloride.

Specific examples of the monomers containing nitrogen or a nitrogen-containing heterocyclic ring include, but are not limited to, vinyl pyridine, vinyl pyrrolidone, vinyl imidazole, and ethylene imine. Specific examples of the polyoxyethylene resins include, but are not limited to, polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester.

Specific examples of the celluloses include, but are not limited to, methyl cellulose, hydroxyethyl cellulose, and hydroxypropyl cellulose.

A dispersion stabilizer is usable when preparing the aqueous dispersion of resin particles. Specific examples of usable dispersion stabilizers include, but are not limited to, acid-soluble or alkali-soluble compounds such as calcium phosphate. The aqueous medium may further includes a catalyst for urea or urethane reaction, such as dibutyl tin laurate or dioctyl tin laurate, when the toner components include a polyester prepolymer.

(3) Preparation of Emulsion Slurry:

In the third step, the toner components liquid is emulsified in the aqueous medium while being agitated. Specific instruments usable for the emulsification include, but are not limited to, batch emulsifiers such as HOMOGENIZER (from IKA Japan), POLYTRON® (from KINEMATICA AG), and TK AUTO HOMO MIXER® (from PRIMIX Corporation); continuous emulsifiers such as EBARA MILDER® (from Ebara Corporation), TK FILMICS® (from PRIMIX Corporation), TK PIPELINE HOMO MIXER® (from PRIMIX Corporation), colloid mill (from SHINKO PANTEC CO., LTD.), slasher, trigonal wet pulverizer (from Mitsui Miike Machinery Co., Ltd.), CAVITRON® (from Eurotec), and FINE FLOW MILL® (from Pacific Machinery & Engineering Co., Ltd.); high-pressure emulsifiers such as MICROFLUIDIZER (from Mizuho Industrial Co., Ltd.), NANOMIZER (from NANOMIZER Inc.), and APV GAULIN (SPX Corporation); film emulsifier (from REICA Co., Ltd.); vibration emulsifiers such as VIBRO MIXER (from REICA Co., Ltd.); and ultrasonic emulsifiers such as ultrasonic homogenizer (from BRANSON). In one or more embodiments, APV GAULIN, HOMOGENIZER, TK AUTO HOMO MIXER®, EBARA MILDER®, TK FILMICS®, or TK PIPELINE HOMO MIXER® is used in view of uniform particle diameter.

(4) Removal of Organic Solvents:

In the fourth step, the organic solvent is removed from the emulsion slurry by gradually heating the emulsion to completely evaporate the organic solvent from liquid droplets or spraying the emulsion into dry atmosphere to completely evaporate the organic solvent from liquid droplets. In the latter case, aqueous dispersants, if any, can also be evaporated.

(5) Washing, Drying, and Classification:

Mother toner particles are isolated by removing the organic solvent from the emulsion slurry in the fourth step. In the fifth step, the mother toner particles are washed, dried, and optionally classified by size. Undesired fine particles are removed by cyclone separation, decantation, or centrifugal separation, in an aqueous medium. Alternatively, dried mother toner particles are subject to classification.

In a case in which a dispersant soluble in acids and bases (e.g., calcium phosphate) is used, the resulting mother particles may be first washed with an acid (e.g., hydrochloric acid) and then washed with water to remove the dispersant.

(6) External Addition of Inorganic Fine Particles:

In the sixth step, the dried toner particles are optionally mixed with inorganic fine particles, such as silica and titanium oxide, followed by application of mechanical impulsive force, so that the fine particles can be fixedly adhered to the surfaces of the mother toner particles. Mechanical impulsive force can be applied to the mother toner particles by agitating the mother toner particles with blades rotating at a high speed, or accelerating the mother toner particles in a high-speed airflow so that the toner particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Usable colorants are not limited in its color. The toner may include either a black, cyan, magenta, or yellow colorant or a combination thereof.

A developer according to an embodiment includes the above-described toner and other components such as a carrier. The developer may be either a one-component developer or a two-component developer. The two-component developer is compatible with high-speed printers, in accordance with recent improvement in information processing speed, owing to its long lifespan.

In the one-component developer according to an embodiment, the average toner size may not vary very much although consumption and supply of toner particles are repeated. Additionally, toner particles may not adhere or fix to a developing roller or a toner layer regulating blade. Thus, the one-component developer reliably provides stable developability and image quality for an extended period of time. In the two-component developer according to an embodiment, the average toner size may not vary very much although consumption and supply of toner particles are repeated. Thus, the two-component developer reliably provides stable developability for an extended period of time.

The carrier may comprise a core material and a resin layer that covers the core material.

Specific examples of usable core materials include, but are not limited to, manganese-strontium (Mn—Sr) and manganese-magnesium (Mn—Mg) materials having a magnetization of 50 to 90 emu/g. High magnetization materials such as iron powders having a magnetization of 100 emu/g or more and magnetites having a magnetization of 75 to 120 emu/g are suitable for improving image density. Additionally, low magnetization materials such as copper-zinc (Cu—Zn) materials having a magnetization of 30 to 80 emu/g are suitable for producing a high-quality image, because carriers made of such materials can weakly contact a photoreceptor. Two or more of these materials can be used in combination.

In some embodiments, the core material has a volume average particle diameter of 10 to 150 μm or 20 to 80 μm.

When the volume average particle diameter is less than 10 μm, it means that the resulting carrier particles include a relatively large amount of fine particles, and therefore the magnetization per carrier particle is too low to prevent carrier particles scattering. When the volume average particle diameter is greater than 150 μm, it means that the specific surface area of the carrier particle is too small to prevent toner particles from scattering. Therefore, solid portions in full-color images may not be reliably reproduced.

Specific examples of usable resins for the resin layer include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidene fluoride-acrylic monomer copolymer, vinylidene fluoride-vinyl fluoride copolymer, tetrafluoroethylene-vinylidene fluoride-non-fluoride monomer terpolymer, and silicone resins. Two or more of these resins can be used in combination.

Specific examples of usable amino resins include, but are not limited to, urea-formaldehyde resin, melamine resin, benzoguanamine resin, urea resin, polyamide resin, epoxy resin. Specific examples of usable polyvinyl resins include, but are not limited to, acrylic resin, polymethyl methacrylate resin, polyacrylonitrile resin, polyvinyl acetate resin, polyvinyl alcohol resin, and polyvinyl butyral resin. Specific examples of usable polystyrene resins include, but are not limited to, polystyrene and styrene-acrylic copolymer. Specific examples of the halogenated olefin resins include, but are not limited to, polyvinyl chloride. Specific examples of the polyester resins include, but are not limited to, polyethylene terephthalate and polybutylene terephthalate.

The resin layer may include a conductive powder such as metal, carbon black, titanium oxide, tin oxide, and zinc oxide. In some embodiments, the conductive powder has a volume average particle diameter of 1 μm or less. When the volume average particle diameter is greater than 1 μm, it may be difficult to control electric resistivity of the resin layer.

The resin layer can be formed by, for example, dissolving a resin (e.g., a silicone resin) in an organic solvent to prepare a coating liquid, and uniformly applying the coating liquid on the surface of the core material, followed by drying and baking. The coating method may be, for example, dip coating, spray coating, or brush coating. Specific examples of usable organic solvents include, but are not limited to, toluene, xylene, methyl ethyl ketone, methyl isobutyl ketone, cellosolve, and butyl acetate. The baking method may be either an external heating method or an internal heating method that uses a stationary electric furnace, a fluid electric furnace, a rotary electric furnace, a burner furnace, or microwave.

In some embodiments, the content of the resin layer in the carrier is 0.01 to 5.0% by weight. When the content of the resin layer is less than 0.01% by weight, it means that the resin layer cannot be uniformly formed on the core material. When the content of the resin layer is greater than 5.0% by weight, it means that the resin layer is so thick that each carrier particles are fused with each other.

In some embodiments, the content of the carrier in the two-component developer is 90 to 98% by weight or 93 to 97% by weight.

The developer may be used for any electrophotographic methods, such as magnetic one-component developing methods, non-magnetic one-component developing methods, and two-component developing methods.

In accordance with some embodiments, the toner or developer can be used for an image forming method including a charging process in which a surface of an electrostatic latent image bearing member is charged; an irradiating process in which the charged surface of the electrostatic latent image bearing member is irradiated with light; a developing process in which the electrostatic latent image is developed into a toner image that is visible with the toner; a transfer process in which the toner image is transferred from the electrostatic latent image bearing member onto a recording medium; and a fixing process in which the toner image is fixed on the recording medium.

In accordance with some embodiments, the toner or developer can be used for an image forming apparatus including an electrostatic latent image bearing member (a photoreceptor); a charger for charging a surface of the electrostatic latent image bearing member; an irradiator for irradiating the charged surface of the electrostatic latent image bearing member with light; a developing device for developing the electrostatic latent image into a toner image that is visible with the toner; a transfer device for transferring the toner image from the electrostatic latent image bearing member onto a recording medium; and a fixing device for fixing the toner image on the recording medium.

Figure 2:
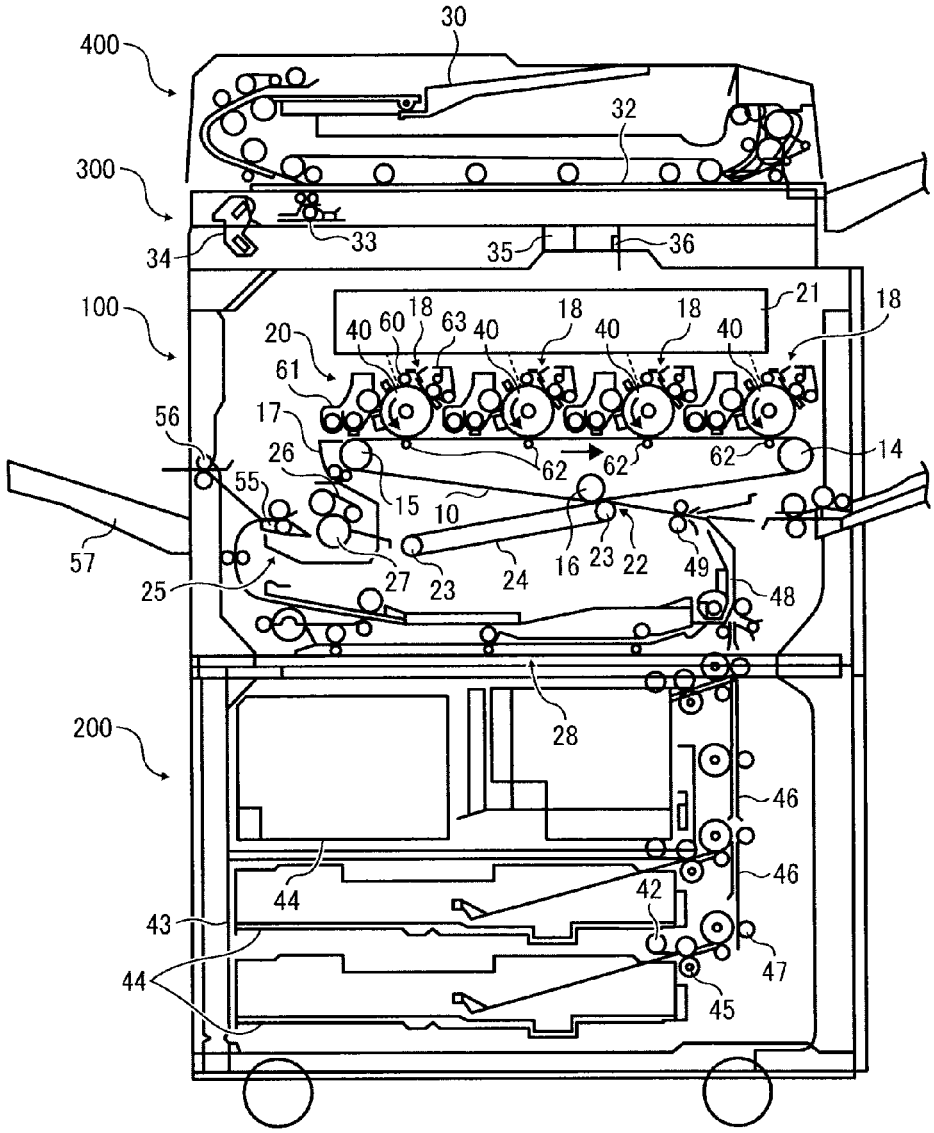
FIG. 2 is a schematic view of an image forming apparatus according to an embodiment.

FIG. 2 is a schematic view of an image forming apparatus according to an embodiment.

The image forming apparatus illustrated in FIG. 2 is a full-color electrophotographic copier employing a tandem-type indirect transfer method.

The image forming apparatus includes a main body 100, a paper feed table 200 disposed below the main body 100, a scanner (a reading optical system) 300 disposed above the main body 100, and an automatic document feeder (ADF) 400 disposed above the scanner 300. A seamless-belt intermediate transfer member 10 is disposed at the center of the main body 100. The intermediate transfer member 10 is stretched across support rollers 14, 15, and 16 to be rotatable clockwise in FIG. 2. An intermediate transfer member cleaner 17 that removes residual toner particles remaining on the intermediate transfer member 10 is disposed on the left side of the support roller 15 in FIG. 2. Four image forming units 18 that produce respective images of black, yellow, magenta, and cyan are disposed along a surface of the intermediate transfer member 10 stretched between the support rollers 14 and 15, thus forming a tandem image forming part 20. An irradiator 21 is disposed immediately above the tandem image forming part 20. A secondary transfer device 22 is disposed on the opposite side of the tandem image forming part 20 relative to the intermediate transfer member 10. The secondary transfer device 22 includes a seamless secondary transfer belt 24 stretched between two rollers 23. The secondary transfer belt 24 is pressed against the support roller 16 with the intermediate transfer member 10 therebetween so that an image is transferred from the intermediate transfer member 10 onto a sheet of a recording medium. A fixing device 25 that fixes a toner image on the sheet is disposed adjacent to the secondary transfer device 22. The fixing device 25 includes a seamless fixing belt 26 and a pressing roller 27. The fixing belt 26 is pressed against the pressing roller 27. The secondary transfer device 22 has a function of feeding the sheet having the toner image thereon to the fixing device 25. A sheet reversing device 28 that reverses a sheet upside down is disposed below the secondary transfer device 22 and the fixing device 25 and in parallel with the tandem image forming part 20.

To make a copy, a document is set on a document table 30 of the automatic document feeder 400. Alternatively, a document is set on a contact glass 32 of the scanner 300 while lifting up the automatic document feeder 400, followed by holding down of the automatic document feeder 400. Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. Thus, the document is read. On the other hand, upon pressing of the switch, one of the support rollers 14, 15, and 16 is driven to rotate by a driving motor and the other two support rollers are driven to rotate by rotation of the rotating support roller so as to rotate and convey the intermediate transfer member 10. In the image forming units 18, single-color toner images of yellow, magenta, cyan, and black are formed on respective photoreceptors 40.

The single-color toner images are sequentially transferred onto the intermediate transfer member 10 along conveyance of the intermediate transfer member 10, thus forming a composite full-color toner image thereon. On the other hand, upon pressing of the switch, one of paper feed rollers 42 starts rotating in the paper feed table 200 so that a sheet of a recording medium is fed from one of paper feed cassettes 44 in a paper bank 43. The sheet is separated by one of separation rollers 45 and fed to a paper feed path 46. Feed rollers 47 feed the sheet to a paper feed path 48 in the main body 100. The sheet is stopped by a registration roller 49. The registration roller 49 feeds the sheet to between the intermediate transfer member 10 and the secondary transfer device 22 in synchronization with an entry of the composite full-color toner image formed on the intermediate transfer member 10.

The sheet is then fed to the fixing device 25 so that the composite full-color toner image is fixed thereon by application of heat and pressure. The sheet having the fixed toner image is switched by a switch claw 55 and discharged onto a discharge tray 57 by a discharge roller 56. Alternatively, the switch claw 55 switches paper feed paths so that the sheet gets reversed in the sheet reversing device 28. After forming another toner image on the back side of the sheet, the sheet is discharged onto the discharge tray 57 by rotating the discharge roller 56.

On the other hand, the intermediate transfer member cleaner 17 removes residual toner particles remaining on the intermediate transfer member 10 without being transferred. Thus, the tandem image forming part 20 gets ready for next image formation.

Figure 3:
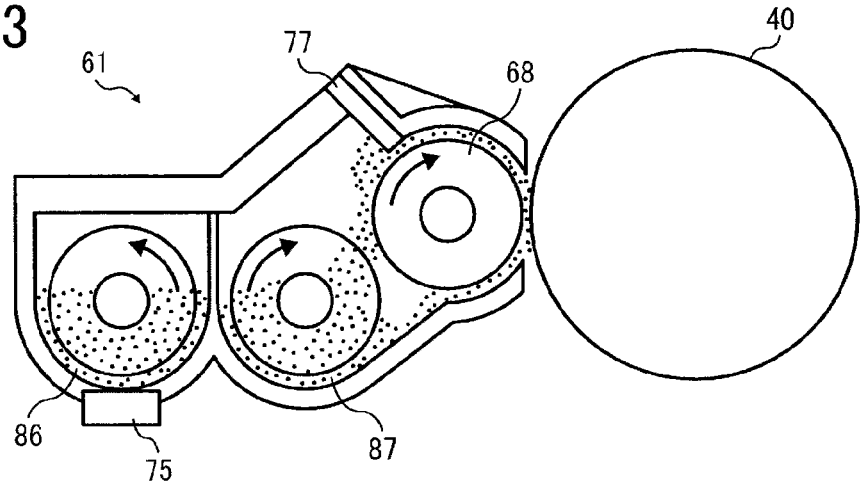
FIG. 3 is a schematic view of the developing device included in the image forming apparatus illustrated in FIG. 2.

In each of the image forming units 18, a charger 60, a developing device 61, a primary transfer device 62, a photoreceptor cleaner 63, and a neutralizer are disposed around the photoreceptor 40. The photoreceptor cleaner 63 includes a blade member. FIG. 3 is a schematic view of the developing device 61. The developing device 61 includes a toner-supplying-side agitating chamber 86, a developing-side agitating chamber 87, a developing sleeve 68, a toner concentration sensor 75, and a doctor blade 77. The toner-supplying-side agitating chamber 86 has a supply opening, through which toner particles are supplied from a toner supplying device, on its outer wall surface. The toner-supplying-side agitating chamber 86 has an agitating screw for agitating and conveying toner particles supplied from the toner supply device and the two-component developer contained in the developing device 61. The developing-side agitating chamber 87 has an agitating screw for agitating and conveying the two-component developer contained in the developing device 61.

Figure 4:
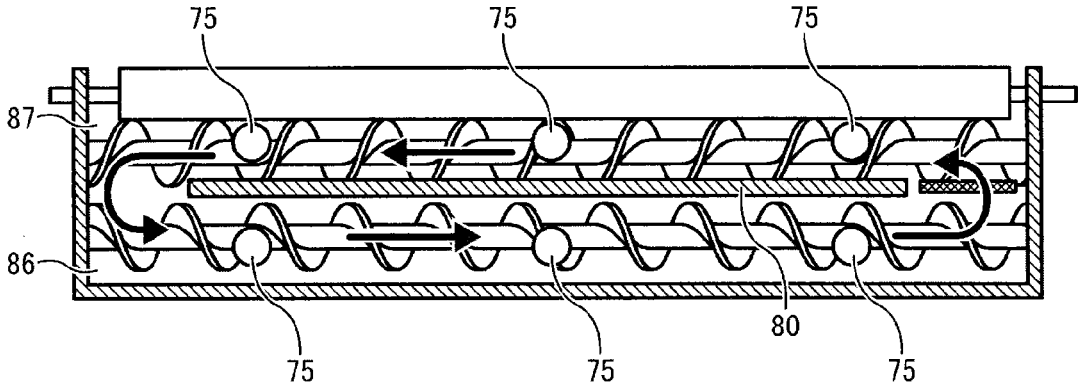
FIG. 4 is an axial sectional view of the developing device illustrated in FIG. 3.

FIG. 4 is an axial sectional view of the developing device 61. The toner-supplying-side agitating chamber 86 and the developing-side agitating chamber 87 are divided by a divider 80. The divider 80 has openings for supplying and receiving the developer on both axial ends. An amount of the developer in the developing-side agitating chamber 87 is supplied to the developing sleeve 68 while the amount is restricted by the doctor blade 77. The developer is further supplied to a position where the developing sleeve 68 is in abrasive contact with the photoreceptor 40. In that position, the developer receives the maximum abrasive force from the doctor blade 77.

Figure 5:
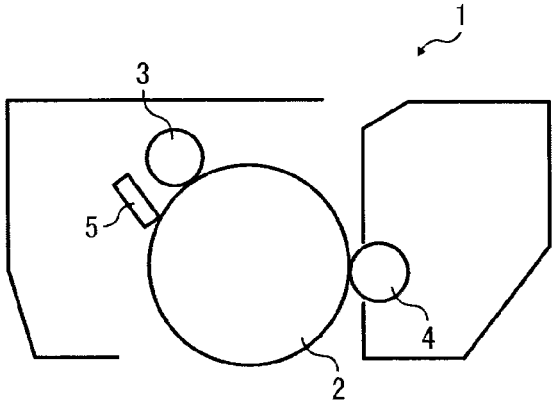
FIG. 5 is a schematic view of a process cartridge according to an embodiment.

FIG. 5 is a schematic view of a process cartridge according to an embodiment. A process cartridge 1 includes a photoreceptor 2, a charger 3, a developing device 4, and a cleaner 5. The process cartridge according to an embodiment integrally supports at least the photoreceptor 2 and the developing device 4 containing the above-described toner and is detachably attachable to image forming apparatuses.

In an image forming apparatus to which the process cartridge 1 is attached, the photoreceptor 2 is driven to rotate at a predetermined peripheral speed. A peripheral surface of the photoreceptor 2 is uniformly charged to a predetermined positive or negative potential by the charger 3 and then irradiated with light by means of slit exposure or laser beam scanning while the photoreceptor 2 is rotating. As a result, electrostatic latent images are sequentially formed on the peripheral surface of the photoreceptor 2. The electrostatic latent images are developed into toner images by the developing device 4. The toner images are sequentially transferred onto a recording medium fed from a paper feed part in synchronization with rotation of the photoreceptor 2. The recording medium having the toner image thereon is separated from the peripheral surface of the photoreceptor 2 and introduced into a fixing device. The recording medium having the fixed toner image thereon is discharged from the image forming apparatus as a copy. The cleaner 5 removes residual toner particles remaining on the peripheral surface of the photoreceptor 2 without being transferred. The cleaned photoreceptor 2 is neutralized to be ready for a next image forming operation.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Measurement of Acid Value

Acid value was measured based on a method according to JIS K0070-1992 as follows.

A sample solution was prepared by dissolving 0.5 g of each polyester resin in 120 mL of THF by agitating them for about 10 hour at room temperature (23° C.) and further adding 30 mL of ethanol thereto.

The sample solution was titrated with 0.1N potassium hydroxide alcohol solution and the acid value was calculated from the following equation.

$$\text{Acid Value}=\text{KOH(mL)}\times N\times 56.1/W$$

wherein KOH represents the consumed amount of the potassium hydroxide alcohol solution, N represents the factor of the potassium hydroxide alcohol solution, and W represents the weight of the sample.

Measurement of Surface Acid Value

An amount of each water dispersion of resin particles, including 20 g of net resin content, was placed in a 200-mL beaker. Deionized water was further added to the beaker so that the total weight became 100 g. The liquid thus prepared was placed in a dialysis tube and agitated for 24 hours while being dipped in 1 L of deionized water. After replacing the deionized water with fresh one, the liquid was subjected to the above dialysis again. This procedure was repeated for 15 days. The liquid was then diluted with deionized water until the solid contents became 10% by weight. The diluted liquid in an amount of 100 g was placed in a 200-mL beaker and mixed with 15 g of a strong acid type ion-exchange resin (AMBERLITE IR120B(H)-AG from Organo Corporation) with a stirrer for about 1 hour. The liquid was sieved a mesh having openings of 150 microns to separate the ion-exchange resin. The filtrate was placed in a dialysis tube and subjected to the dialysis for 15 days again so that unwanted ions existing in the water dispersion were removed. Thus, a sample liquid was prepared.

An amount of the sample liquid, including 1 g of net resin content, was placed in a 100-mL beaker. Deionized water was further added to the beaker so that the total weight became 50 g. The diluted sample liquid was conductivity-titrated with 0.1N potassium hydroxide aqueous solution to determine the surface acid value.

Preparation of Resins [b-1] and [b-2]

In an autoclave reaction vessel equipped with a thermometer, a stirrer, and a nitrogen inlet pipe, raw materials described in the column (b11) of Table 1 and 2 parts of tin 2-ethylhexanoate were subjected to a ring-opening polymerization at normal pressure and 160° C. for 3 hours and a subsequent reaction at normal pressure and 130° C. The resulting resin was cooled to room temperature and pulverized into particles. Thus, polyester diols (b11)-1 and (b11)-2 each having a polyhydroxycarboxylic acid skeleton were prepared.

Next, raw materials described in the column (b12) of Table 1 were subjected to a dehydration condensation. Thus, polyester diols (b12)-1 and (b12)-2 were prepared. Each combinations of the polyester diols (b11)-1 with (b12)-1 and the polyester diols (b11)-2 with (b12)-2 was dissolved in methyl ethyl ketone and subjected to an elongation reaction with an IPDI (i.e., an elongating agent) for 6 hours at 50° C., followed by removal of the solvent. Thus, resins [b-1] and [b-2] were prepared.

TABLE 1

| | Resin (b1) | | | | | |
|---|---|---|---|---|---|---|
| | | | | | Polyester Diol (b12) | |
| | Polyester Diol (b11) | | | | EO 2 mol | |
| Resin No. | 1,3-Propanediol (parts) | 1,4-Butanediol (parts) | L-Lactide (parts) | D-Lactide (parts) | Adduct of Bisphenol A (parts) | Terephthalic Acid (parts) |
| [b-1] | 2 | 0 | 54 | 14 | 15 | 15 |
| [b-2] | 0 | 2 | 50 | 13 | 17.5 | 17.5 |

Preparation of Resins [b-3] and [b-4]

Raw materials described in Table 2 (i.e., L-lactide, D-lactide, ϵ-caprolactone, and tin ocrylate) were placed in a four-necked flask and heated and melted at 190° C. under nitrogen atmosphere for 20 minutes.

After termination of the reaction, residual lactide and ϵ-caprolactone were removed under reduced pressures. Thus, resins [b-3] and [b-4] were prepared.

TABLE 2

| Resin No. | L-Lactide (parts) | D-Lactide (parts) | ϵ-Caprolactone (parts) | Tin Octylate (parts) |
|---|---|---|---|---|
| [b-3] | 80 | 20 | 10 | 1 |
| [b-4] | 70 | 30 | 5 | 1 |

Preparation of Polyester Prepolymer

In a reaction vessel equipped with a condenser, a stirrer, and a nitrogen inlet pipe, 720 parts of ethylene oxide 2 mol adduct of bisphenol A, 90 parts of propylene oxide 2 mol adduct of bisphenol A, 290 parts of terephthalic acid, 25 parts of trimellitic anhydride, and 2 parts of dibutyltin oxide were subjected to a reaction for 8 hours at 230° C. under normal pressures and subsequent 7 hours under reduced pressures of 10 to 15 mmHg. Thus, an intermediate polyester resin was prepared. The intermediate polyester resin had a number average molecular weight (Mn) of 2,500, a weight average molecular weight (Mw) of 10,700, a peak molecular weight of 3,400, a glass transition temperature (Tg) of 57° C., an acid value of 0.4 mgKOH/g, and a hydroxyl value of 49 mgKOH/g.

In another reaction vessel equipped with a condenser, a stirrer, and a nitrogen inlet pipe, 400 parts of the intermediate polyester resin, 95 parts of isophorone diisocyanate, and 580 parts of ethyl acetate were subjected to a reaction for 8 hours at 100° C. Thus, a polyester prepolymer was prepared. The polyester prepolymer was including 1.42% of free isocyanates.

Preparation of Ketimine Compound

In a reaction vessel equipped with a stirrer and a thermometer, 30 parts of isophoronediamine and 70 parts of methyl ethyl ketone were subjected to a reaction for 5 hours at 50° C. Thus, a ketimine compound was prepared. The ketimine compound had an amine value of 423 mgKOH/g.

Preparation of Resins [a-2] and [a-8]

In an autoclave reaction vessel, a mixture of raw materials (i.e., acid and alcohol components) described in Table 3 was heated at 260° C. for 2.5 hours to cause an esterification reaction. After adding 0.262 parts of germanium dioxide as a catalyst, the reaction system temperature was increased to 280° C. over a period of 30 minutes and the reaction system pressure was gradually reduced to 0.1 Torr over a period of 1 hour. The polycondensation reaction was further continued for 1.5 hours and the reaction system pressure was returned to normal pressure by introducing nitrogen gas and the reaction system temperature was reduced to 260° C. Thereafter, 50 parts of isophthalic acid and 37 parts of trimellitic anhydride were further added to the vessel and the mixture was agitated at 255° C. for 30 minutes, thus obtaining a sheet-like resin.

Properties of resin [a-2] to [a-8] are described in Table 3.

TABLE 3

| | Acid Components | | | | | Alcohol Components | | Properties | | |
|---|---|---|---|---|---|---|---|---|---|---|
| Resin No. | Terephthalic Acid (parts) | Isophthalic Acid (parts) | Trimellitic Acid (parts) | Phthalic Acid (parts) | Adipic Acid (parts) | Ethylene Glycol (parts) | Neopentyl Glycol (parts) | Acid Value (mgKOH/g) | Mw | Tg (° C.) |
| [a-1] | 1,250 | 130 | 360 | 0 | 0 | 280 | 570 | 26.9 | 12,000 | 65 |
| [a-2] | 1,500 | 30 | 190 | 0 | 0 | 250 | 620 | 18.6 | 18,000 | 67 |
| [a-3] | 1,400 | 133 | 0 | 50 | 40 | 280 | 570 | 15.3 | 20,000 | 64 |
| [a-4] | 1,150 | 260 | 150 | 30 | 160 | 280 | 570 | 32.8 | 11,000 | 60 |
| [a-5] | 1,600 | 120 | 0 | 0 | 0 | 300 | 540 | 35.1 | 9,500 | 65 |
| [a-6] | 950 | 480 | 110 | 0 | 230 | 210 | 520 | 19.8 | 15,000 | 69 |
| [a-7] | 1,400 | 300 | 0 | 40 | 0 | 190 | 720 | 12.8 | 23,000 | 60 |
| [a-8] | 1,500 | 230 | 0 | 0 | 0 | 200 | 700 | 8.5 | 29,000 | 67 |

Preparation of Master Batch

First, 1,000 parts of water, 530 parts of a carbon black (PRINTEX 35 from Degussa) having a DBP oil absorption of 42 mL/100 g and a pH of 9.5, and 1,200 parts of each of the resins [b-1] to [b-4] were mixed by a HENSCHEL MIXER (from Mitsui Mining and Smelting Co., Ltd.). The resulting mixture was kneaded for 30 minutes at 150° C. by double rolls, the kneaded mixture was then rolled and cooled, and the rolled mixture was then pulverized into particles by a pulverizer (from Hosokawa Micron Corporation). Thus, master batches [b-1] to [b-4] were prepared.

Preparation of Resin [a-1]

In an autoclave reaction vessel, a mixture of 1,250 parts of terephthalic acid, 130 parts of isophthalic acid, 360 parts of trimellitic acid, 280 parts of ethylene glycol, and 570 parts of neopentyl glycol was heated at 260° C. for 2.5 hours to cause an esterification reaction. After adding 0.262 parts of germanium dioxide as a catalyst, the reaction system temperature was increased to 280° C. over a period of 30 minutes and the reaction system pressure was gradually reduced to 0.1 Torr over a period of 1 hour. The polycondensation reaction was further continued for 1.5 hours and the reaction system pressure was returned to normal pressure by introducing nitrogen gas and the reaction system temperature was reduced to 260° C. Thereafter, 50 parts of isophthalic acid and 37 parts of trimellitic anhydride were further added to the vessel and the mixture was agitated at 255° C. for 30 minutes, thus obtaining a sheet-like resin.

After being cooled to room temperature, the sheet-like resin was pulverized into particles and the particles were sieved. The particles collected with a sieve having openings of 1 to 6 mm were collected. Thus, a polyester resin [a-1] was prepared. Properties of the resin [a-1] are described in Table 3.

Preparation of Resin Particle Dispersion [w-1]

In a 2-L glass container equipped with a jacket, 200 parts of the resin [a-1] were dissolved in 300 parts of methyl ethyl ketone and N,N-dimethylethanolamine ("DMEA") in an amount 1.2 times the equivalent amount of carboxyl groups in the resin [a-1], determined from the acid value of the resin [a-1], was further added thereto. While the mixture was agitated by a desktop disperser (TK ROBOMICS from PRIMIX Corporation) at a revolution of 6,000 rpm in the opened container, 1 L of ion-exchange water was gradually added to the container to cause a phase-transfer emulsification. The resulting emulsion was subjected to distillation under reduced pressures so that the methyl ethyl ketone was removed and subsequent filtration with a stainless-steel filter (635 mesh with plain weave). Thus, a resin particle dispersion [w-1] was prepared as the filtrate.

Preparation of Resin Particle Dispersions [w-2] to [w-8]

The procedure for preparing the resin particle dispersion [w-1] was repeated except for replacing the resin [a-1] with each of the resins [a-2] to [a-8]. Thus, resin particle dispersions [w-2] to [w-8] were prepared.

Preparation of Resin Particle Dispersion [w-9]

In a 2-L glass container equipped with a jacket, 200 parts of the resin [a-1] were dissolved in 300 parts of methyl ethyl ketone and N,N-dimethylethanolamine in an amount 0.8 times the equivalent amount of carboxyl groups in the resin [a-1], determined from the acid value of the resin [a-1], was further added thereto. While the mixture was agitated by the desktop disperser at a revolution of 6,000 rpm in the opened container, 1 L of ion-exchange water were gradually added to the container to cause a phase-transfer emulsification. The resulting emulsion was subjected to distillation under reduced pressures so that the methyl ethyl ketone was removed and subsequent filtration with a stainless-steel filter (635 mesh with plain weave). Thus, a resin particle dispersion [w-9] was prepared as the filtrate.

Preparation of Resin Particle Dispersion [w-10]

In a 2-L glass container equipped with a jacket, 100 parts of the resin [a-1] were dissolved in 300 parts of methyl ethyl ketone and N,N-dimethylethanolamine in an amount 1.4 times the equivalent amount of carboxyl groups in the resin [a-1], determined from the acid value of the resin [a-1], was further added thereto. While the mixture was agitated by the desktop disperser at a revolution of 12,000 rpm in the opened container in an ice bath, 1 L of ion-exchange water were added to the container at a speed of 10 mL/min to cause a phase-transfer emulsification. The resulting emulsion was subjected to distillation under reduced pressures so that the methyl ethyl ketone was removed and subsequent filtration with a stainless-steel filter (635 mesh with plain weave). Thus, a resin particle dispersion [w-10] was prepared as the filtrate.

Preparation of Resin Particle Dispersion [w-11]

In a reaction vessel equipped with a stirrer and a thermometer, 600 parts of water, 120 parts of styrene, 100 parts of methacrylic acid, 45 parts of butyl acrylate, 10 parts of a sodium alkylallylsulfosuccinate (ELEMINOL JS-2 from Sanyo Chemical Industries, Ltd.), and 1 part of ammonium persulfate were agitated for 20 minutes at a revolution of 400 rpm. Thus, a white emulsion was prepared. The white emulsion was heated to 75° C. and subjected to a reaction for 6 hours. A 1% aqueous solution of ammonium persulfate in an amount of 30 parts was further added to the emulsion, and the mixture was aged for 6 hours at 75° C. Thus, a resin particle dispersion [w-11] being an aqueous dispersion of a vinyl resin (i.e., a copolymer of styrene, methacrylic acid, butyl acrylate, and sodium alkylallylsulfosuccinate) was prepared.

Evaluations of Resin Particle Dispersions [w-1] to [w-11]

The resin particle dispersions [w-1] to [w-11] were subjected to a measurement of surface acid value in the above-described manner. The resin particle dispersions [w-1] to [w-11] were further subjected to a measurement of volume average particle diameter with a laser Doppler particle size analyzer ELS-800 (from Otsuka Electronics Co., Ltd.). The results are shown in Table 4.

TABLE 4

| Resin | | Properties | | | | |
|---|---|---|---|---|---|---|
| Particle Dispersion No. | Resin (a) No. | Acid Value (mgKOH/g) | Mw | Tg (° C.) | Surface Acid Value (mgKOH/g) | Dv (μm) |
| [w-1] | [a-1] | 26.9 | 12,000 | 65 | 20.7 | 0.058 |
| [w-2] | [a-2] | 18.6 | 18,000 | 67 | 16.4 | 0.085 |
| [w-3] | [a-3] | 15.3 | 20,000 | 64 | 10.5 | 0.071 |
| [w-4] | [a-4] | 32.8 | 11,000 | 60 | 26.7 | 0.045 |
| [w-5] | [a-5] | 35.1 | 9,500 | 65 | 23.3 | 0.038 |
| [w-6] | [a-6] | 19.8 | 15,000 | 69 | 8.3 | 0.083 |
| [w-7] | [a-7] | 12.8 | 23,000 | 60 | 5.7 | 0.092 |
| [w-8] | [a-8] | 8.5 | 29,000 | 67 | 4.8 | 0.095 |
| [w-9] | [a-1] | 26.9 | 12,000 | 65 | 18.5 | 0.106 |
| [w-10] | [a-1] | 26.9 | 12,000 | 65 | 21.6 | 0.028 |
| [w-11] | — | 50 or more | 440,000 | 66 | 16.1 | 0.042 |

Preparation of Aqueous Media 1 to 11

Aqueous media 1 to 11 were prepared by uniformly mixing and agitating 300 parts of ion-exchange water, 300 parts of the resin particle dispersion [w-1] to [w-11], respectively, and 0.2 parts of sodium dodecylbenzenesulfonate.

Preparation of Resin Solutions 1 to 4

Resin solutions 1 to 4 were prepared by mixing and agitating the resins [b-1] to [b-4], respectively, and the polyester prepolymer, in amounts described in Table 5, and 80 parts of ethyl acetate in a reaction vessel.

TABLE 5

| Resin | Resin (b) | | Resin (b0) |
|---|---|---|---|
| Solution No. | No. | Content (parts) | (Polyester Prepolymer) Content (parts) |
| 1 | [b-1] | 85 | 15 |
| 2 | [b-2] | 80 | 20 |
| 3 | [b-3] | 100 | 0 |
| 4 | [b-4] | 100 | 0 |

Preparation of Mother Toner 1

The resin solution 1 in an amount of 90 parts, a carnauba wax (having a molecular weight of 1,800, an acid value of 2.7 mgKOH/g, and a penetration of 1.7 mm (at 40° C.)) in an amount of 5 parts, and the master batch [b-1] in an amount of 5 parts were subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. This dispersing operation was repeated 3 times (3 passes). Further, 2.5 parts of the ketimine compound were added to the resulting liquid. Thus, a toner components liquid was prepared.

In a vessel, 150 parts of the aqueous medium 1 were mixed and agitated with 100 parts of the toner components liquid for 10 minutes by a TK HOMOMIXER (from PRIMIX Corporation) at a revolution of 12,000 rpm. Thus, an emulsion slurry was prepared. A flask equipped with a stirrer and a thermometer was charged with 100 parts of the emulsion slurry. The emulsion slurry was agitated for 10 hours at 30° C. at a peripheral speed of 20 m/min so that the solvents were removed therefrom. Thus, a dispersion slurry was prepared. Next, 100 parts of the dispersion slurry was filtered under reduced pressures to obtain a wet cake (i). The wet cake (i) was then mixed with 100 parts of ion-exchange water using a TK HOMOMIXER for 10 minutes at a revolution of 12,000 rpm, followed by filtration, thus obtaining a wet cake (ii). The wet cake (ii) was mixed with 300 parts of ion-exchange water using a TK HOMOMIXER for 10 minutes at a revolution of 12,000 rpm, followed by filtration. This operation was repeated twice, thus obtaining a wet cake (iii). The wet cake (iii) was mixed with 20 parts of a 10% aqueous solution of sodium hydroxide using a TK HOMOMIXER for 30 minutes at a revolution of 12,000 rpm, followed by filtration under reduced pressures, thus obtaining a wet cake (iv). The wet cake (iv) was mixed with 300 parts of ion-exchange water using a TK HOMOMIXER for 10 minutes at a revolution of 12,000 rpm, followed by filtration, thus obtaining a wet cake (v). The wet cake (v) was mixed with 300 parts of ion-exchange water using a TK HOMOMIXER for 10 minutes at a revolution of 12,000 rpm, followed by filtration. This operation was repeated twice, thus obtaining a wet cake (vi). The wet cake (vi) was mixed with 20 parts of a 10% hydrochloric acid using a TK HOMOMIXER for 10 minutes at a revolution of 12,000 rpm, and further mixed with an amount of a 5% methanol solution of a fluorine-containing quaternary ammonium salt (FTERGENT F-310 from Neos Company Limited) so that the resulting mixture was including 0.1 parts of the fluorine-containing quaternary ammonium salt based on 100 parts of the solid contents for 10 minutes, followed by filtration, thus obtaining a wet cake (vii). The wet cake (vii) was mixed with 300 parts of ion-exchange water using a TK HOMOMIXER for 10 minutes at a revolution of 12,000 rpm, followed by filtration. This operation was repeated twice, thus obtaining a wet cake (viii). The wet cake (viii) was dried by a circulating drier for 36 hours at 40° C., and filtered with a mesh having openings of 75 μm. Thus, a mother toner 1 was prepared.

Preparation of Mother Toners 2 to 12

The procedure for preparing the mother toner 1 was repeated except for changing the composition as described in Table 6. Thus, mother toners 2 to 12 were prepared.

Preparation of Mother Toners 13 to 14

The procedure for preparing the mother toner 1 was repeated except that the composition was changed as described in Table 6, the emulsification period was changed from 10 minutes to 3 minutes, and the solvent removal process was changed such that, after the solvent had been removed from the emulsion slurry at 30° C. for 10 minutes, the emulsion slurry was diluted with 100 parts of ion-exchange water and subjected to subsequent solvent removal for 10 hours, so that the particle size distribution Dv/Dn of the resulting particles did not exceed 1.25. Thus, mother toners 13 to 14 were prepared.

Preparation of Mother Toners 15 to 25

The procedure for preparing the mother toner 1 was repeated except for changing the composition as described in Table 6. Thus, mother toners 15 to 25 were prepared.

TABLE 6

| Mother Toner No. | Resin Solution No. | Resin Solution Composition: Resin (b) No. | Resin (b) Content (parts) | Resin (b0) (Polyester Prepolymer) Content (parts) | Resin Particle Dispersion No. |
|---|---|---|---|---|---|
| 1 | 1 | [b-1] | 85 | 15 | [w-1] |
| 2 | 1 | [b-1] | 85 | 15 | [w-2] |
| 3 | 1 | [b-1] | 85 | 15 | [w-3] |
| 4 | 2 | [b-2] | 80 | 20 | [w-1] |
| 5 | 2 | [b-2] | 80 | 20 | [w-3] |
| 6 | 2 | [b-2] | 80 | 20 | [w-4] |
| 7 | 3 | [b-3] | 100 | 0 | [w-1] |
| 8 | 3 | [b-3] | 100 | 0 | [w-2] |
| 9 | 3 | [b-3] | 100 | 0 | [w-5] |
| 10 | 4 | [b-4] | 100 | 0 | [w-3] |
| 11 | 4 | [b-4] | 100 | 0 | [w-4] |
| 12 | 4 | [b-4] | 100 | 0 | [w-5] |
| 13 | 1 | [b-1] | 85 | 15 | [w-9] |
| 14 | 1 | [b-1] | 85 | 15 | [w-10] |
| 15 | 1 | [b-1] | 85 | 15 | [w-6] |
| 16 | 1 | [b-1] | 85 | 15 | [w-7] |
| 17 | 2 | [b-2] | 80 | 20 | [w-7] |
| 18 | 2 | [b-2] | 80 | 20 | [w-8] |
| 19 | 3 | [b-3] | 100 | 0 | [w-6] |
| 20 | 3 | [b-3] | 100 | 0 | [w-8] |
| 21 | 4 | [b-4] | 100 | 0 | [w-6] |
| 22 | 4 | [b-4] | 100 | 0 | [w-7] |
| 23 | 1 | [b-1] | 85 | 15 | [w-11] |
| 24 | 2 | [b-2] | 80 | 20 | [w-11] |
| 25 | 3 | [b-3] | 100 | 0 | [w-11] |

Preparation of Toners

Each of the mother toners 1 to 25 in an amount of 100 parts was mixed with 1.0 part of a hydrophobized silica (H2000 from Clariant Japan K.K.) by a HENSCHEL MIXER (from Mitsui Mining Co., Ltd.) at a peripheral speed of 30 msec for 30 seconds, followed by a pause for 1 minute. This mixing operation was repeated for 5 times (5 cycles). The mixture was sieved with a mesh having openings of 35 μm. Thus, toners 1 to 25 were prepared. Preparation of Carrier A resin layer coating liquid was prepared by dispersing 100 parts of a silicone resin (organo straight silicone), 5 parts of γ-(2-aminoethyl)aminopropyl trimethoxysilane, and 10 parts of a carbon black in 100 parts of toluene by a homomixer for 20 minutes. The resin layer coating liquid was applied to the surfaces of 1,000 parts of magnetite particles having a volume average particle diameter of 50 μm by a fluidized bed coating device. Thus, a carrier was prepared. Preparation of Developer Each of the toners 1 to 25 in an amount of 5 parts and the carrier in an amount of 95 parts were mixed. Thus, developers 1 to 25 were prepared. The developers were subjected to the following evaluations of fixability, image density, environmental stability, and toner filming resistance. The results are shown in Table 7.

TABLE 7

| | Mother Toner No. | Dv (μm) | Dn (μm) | Dv/Dn | Minimum Fixable Temp. | Maximum Fixable Temp. | Image Density | Environmental Stability | Toner Filming Resistance |
|---|---|---|---|---|---|---|---|---|---|
| Example 1 | 1 | 5.5 | 5.0 | 1.11 | A | A | A | A | A |
| Example 2 | 2 | 5.6 | 5.0 | 1.13 | A | A | A | A | A |
| Example 3 | 3 | 5.5 | 4.8 | 1.15 | A | A | A | A | A |
| Example 4 | 4 | 5.5 | 5.0 | 1.11 | A | A | A | A | A |
| Example 5 | 5 | 5.5 | 4.9 | 1.13 | A | A | A | A | A |
| Example 6 | 6 | 5.6 | 5.0 | 1.11 | A | A | A | B | A |
| Example 7 | 7 | 5.7 | 4.9 | 1.17 | A | B | A | A | A |
| Example 8 | 8 | 5.4 | 4.6 | 1.18 | A | A | A | A | A |
| Example 9 | 9 | 5.6 | 4.7 | 1.19 | A | A | A | B | A |
| Example 10 | 10 | 5.6 | 4.7 | 1.2 | A | A | B | A | A |
| Example 11 | 11 | 5.6 | 4.7 | 1.19 | A | A | A | B | A |
| Example 12 | 12 | 5.7 | 4.8 | 1.18 | A | A | A | B | A |
| Example 13 | 13 | 5.7 | 4.7 | 1.21 | A | A | A | B | B |
| Example 14 | 14 | 5.3 | 4.3 | 1.23 | A | A | A | A | B |
| Comparative Example 1 | 15 | 5.3 | 4.5 | 1.17 | A | A | A | B | C |
| Comparative Example 2 | 16 | 5.6 | 4.4 | 1.26 | A | A | B | B | C |

TABLE 7-continued

| | Mother Toner No. | Dv (μm) | Dn (μm) | Dv/Dn | Minimum Fixable Temp. | Maximum Fixable Temp. | Image Density | Environmental Stability | Toner Filming Resistance |
|---|---|---|---|---|---|---|---|---|---|
| Comparative Example 3 | 17 | 5.7 | 4.2 | 1.35 | A | B | A | C | D |
| Comparative Example 4 | 18 | 5.5 | 3.5 | 1.55 | A | A | C | D | D |
| Comparative Example 5 | 19 | 5.6 | 4.5 | 1.25 | A | A | B | C | C |
| Comparative Example 6 | 20 | 5.7 | 3.7 | 1.56 | A | B | C | D | D |
| Comparative Example 7 | 21 | 5.6 | 4.5 | 1.25 | A | A | B | C | D |
| Comparative Example 8 | 22 | 5.6 | 3.7 | 1.5 | A | A | C | D | D |
| Comparative Example 9 | 23 | 5.7 | 4.8 | 1.18 | B | B | A | D | B |
| Comparative Example 10 | 24 | 5.6 | 4.7 | 1.19 | B | B | A | D | C |
| Comparative Example 11 | 25 | 5.5 | 4.4 | 1.25 | B | B | A | D | C |

Evaluation of Fixability

An electrophotographic copier (MF-200 from Ricoh Co., Ltd.) employing a TEFLON® fixing roller is modified so that the temperature of the fixing roller is variable. Each developer is mounted on the copier, and a solid image having 0.85±0.1 mg/cm$^2$ of toner is formed on sheets of a normal paper TYPE 6200 (from Ricoh Co., Ltd.) and a thick paper <135> (from NBS Ricoh) while varying the temperature of the fixing roller to determine the maximum and minimum fixable temperatures. The maximum fixable temperature is a temperature above which hot offset occurs on the normal paper. The minimum fixable temperature is a temperature below which the residual rate of image density after rubbing the solid image falls below 70% on the thick paper.

Maximum Fixable Temperature Grades

A: not less than 190° C.

B: not less than 180° C. and less than 190° C.

C: not less than 170° C. and less than 180° C.

D: less than 170° C.

Minimum Fixable Temperature Grades

A: less than 135° C.

B: not less than 135° C. and less than 145° C.

C: not less than 145° C. and less than 155° C.

D: not less than 155° C.

Evaluation of Image Density

Each developer is mounted on a tandem full-color image forming apparatus (IMAGIO NEO 450 from Ricoh Co., Ltd.), and a solid image having 1.00±0.05 mg/cm$^2$ of toner is formed on a sheet of a paper TYPE 6000 <70 W> (from Ricoh Co., Ltd.) while setting the temperature of the fixing roller to 160±2° C. Six randomly-selected portions in the solid image are subjected to a measurement of image density with a spectrophotometer (938 spectrodensitometer from X-Rite). The measured image density values are averaged and graded as follows.

A: not less than 2.0

B: not less than 1.70 and less than 2.0

Evaluation of Environmental Stability

Each developer is agitated by a ball mill for 5 minutes at 23° C., 50% RH (i.e., M/M environment). Thereafter, 1.0 g of the developer is taken out and subjected to a measurement of charge quantity (CQ) by a blow off charge measuring device (TB-200 from KYOCERA Chemical Corporation). The charge quantity is measured after the developer is exposed to nitrogen gas blow for 1 minute. The same procedure is repeated at 40° C., 90% RH (i.e., H/H environment) and at 10° C., 30% RH (i.e., L/L environment).

Environmental variation is calculated from the following formula. The smaller the environmental variation of a developer, the better the charge stability of the developer.

$$\text{Environmental variation}(\%)=(CQ(L/L)-CQ(H/H))/\{(CQ(L/L)+CQ(H/H))/2\}$$

A: less than 10%

B: not less than 10% and less than 30%

C: not less than 30% and less than 50%

D: not less than 50%

Evaluation of Toner Filming Resistance

Each developer is mounted on a tandem full-color image forming apparatus (IMAGIO NEO 450 from Ricoh Co., Ltd.). An image chart having an image area occupancy of 20% is printed out while controlling the toner concentration so that the resulting image density becomes 1.4±0.2. An initial charge quantity A (μC/g) of the developer and a charge quantity B (μC/g) of the developer after printing 200,000th sheets are measured by a blow off method and the degree of decrease is calculated from the following equation: [(A−B)/A]×100(%).

A: less than 15%

B: not less than 15% and less than 30%

C: not less than 30% and less than 50%

D: not less than 50%

When toner particles form their film on carrier particles in the developer, charging ability of the carrier particles deteriorate. The smaller the degree of decrease of charge quantity, the smaller the degree of toner film formation on carrier particles.

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising:

a resin particle (C) including:

a resin particle (B), the resin particle (B) including a resin (b); and a resin particle (A) or covering layer (P), the resin particle (A) or covering layer (P) including a resin (a), the resin particle (A) or covering layer (P) being adhered to a surface of the resin particle (B), wherein:

the resin (a) is a polyester resin, the resin (a) has a total acid value of 15 to 36 mgKOH/g, and the resin particle (A) or covering layer (P) has a surface acid value of 10 to 27 mgKOH/g, and wherein the resin (b) has a polyhydroxycarboxylic acid skeleton obtained from optically-active monomers, the polyhydroxycarboxylic acid skeleton having an optical purity X of 80% by mole or less, the optical purity X being represented by the following formula:

$$X(\%\text{ by mole})=|X(L\text{-form})-X(D\text{-form})|$$

wherein X(L-form) and X(D-form) represent ratios (% by mole) of L-form and D-form optically-active monomers, respectively.

2. The toner according to claim 1, wherein the resin particle (A) has a volume average particle diameter of 0.03 to 0.10 μm.

3. The toner according to claim 1, wherein the resin (a) has a polyester unit obtained from at least a polybasic acid and a polyol.

4. The toner according to claim 1, wherein the resin (b) has a polyhydroxycarboxylic acid skeleton obtained from optically-active monomers, the polyhydroxycarboxylic acid skeleton having an optical purity X of 60% by mole or less, the optical purity X being represented by the following formula:

$$X(\%\text{ by mole})=|X(L\text{-form})-X(D\text{-form})|$$

wherein X(L-form) and X(D-form) represent ratios (% by mole) of L-form and D-form optically-active monomers, respectively.

5. The toner according to claim 1, wherein the resin (b) has a polyhydroxycarboxylic acid skeleton obtained by copolymerizing a hydroxycarboxylic acid having 2 to 6 carbon atoms.

6. The toner according to claim 1, wherein the resin (b) includes a straight-chain polyester resin (b1) obtained by reacting a polyester diol (b11) having a polyhydroxycarboxylic acid skeleton with a polyester diol (b12) other than the polyester diol (b11) with an elongating agent.

7. The toner according to claim 6, wherein a weight ratio of the polyester diol (b11) to the polyester diol (b12) is 31/69 to 90/10.

8. The toner according to claim 1, wherein the resin (b) includes:

a straight-chain polyester resin (b1); and a resin (b2) obtained by reacting a precursor (b0) during formation of the resin particle (C).

9. A developer, comprising the toner according to claim 1 and a carrier.

10. The toner according to claim 1, wherein said resin particle (C) comprises said resin particle (B) and said resin particle (A).

11. The toner according to claim 1, wherein said resin particle (C) comprises resin particle (B) and said covering layer (P).

12. The toner according to claim 2, wherein said resin particle (C) comprises said resin particle (B) and said resin particle (A).

13. The toner according to claim 2, wherein said resin particle (C) comprises resin particle (B) and said covering layer (P).

14. The toner according to claim 3, wherein said resin particle (C) comprises said resin particle (B) and said resin particle (A).

15. The toner according to claim 3, wherein said resin particle (C) comprises resin particle (B) and said covering layer (P).

16. The toner according to claim 4, wherein said resin particle (C) comprises said resin particle (B) and said resin particle (A).

17. The toner according to claim 4, wherein said resin particle (C) comprises resin particle (B) and said covering layer (P).

* * * * *